US009249357B2

(12) United States Patent
Quanci et al.

(10) Patent No.: US 9,249,357 B2
(45) **Date of Patent: *Feb. 2, 2016**

(54) METHOD AND APPARATUS FOR VOLATILE MATTER SHARING IN STAMP-CHARGED COKE OVENS

(75) Inventors: John F. Quanci, Haddonfield, NJ (US); Vince G. Reiling, Wheaton, IL (US)

(73) Assignee: SunCoke Technology and Development LLC., Lisle, IL (US)

( * ) Notice: Subject to any disclaimer, the term of this patent is extended or adjusted under 35 U.S.C. 154(b) by 686 days.

This patent is subject to a terminal disclaimer.

(21) Appl. No.: 13/589,004

(22) Filed: Aug. 17, 2012

(65) Prior Publication Data

US 2014/0048404 A1 Feb. 20, 2014

(51) Int. Cl.

| | |
|---|---|
| ***C10B 15/02*** | (2006.01) |
| ***C10B 27/04*** | (2006.01) |
| ***C10B 27/06*** | (2006.01) |
| ***C10B 29/00*** | (2006.01) |
| ***C10B 31/10*** | (2006.01) |
| *C10B 1/00* | (2006.01) |
| *C10B 1/02* | (2006.01) |
| *C10B 1/04* | (2006.01) |

(52) U.S. Cl.

CPC ..... *C10B 15/02* (2013.01); *C10B 27/04* (2013.01); *C10B 27/06* (2013.01); *C10B 29/00* (2013.01); *C10B 31/10* (2013.01); *C10B 1/00* (2013.01); *C10B 1/02* (2013.01); *C10B 1/04* (2013.01)

(58) Field of Classification Search

CPC ..... C10B 5/00; C10B 5/02; C10B 5/04; C10B 5/12; C10B 5/14; C10B 27/00; C10B 27/06

See application file for complete search history.

(56) References Cited

U.S. PATENT DOCUMENTS

| | | | |
|---|---|---|---|
| 469,868 | A | 3/1892 | Thomas et al. |
| 1,140,798 | A | 5/1915 | Carpenter |
| 1,424,777 | A | 8/1922 | Schondeling |
| 1,430,027 | A | 9/1922 | Plantinga |
| 1,486,401 | A | 3/1924 | Van Ackeren |
| 1,572,391 | A | 2/1926 | Klaiber |
| 1,721,813 | A | 7/1929 | Geipert et al. |
| 1,818,370 | A | 8/1931 | Wine |
| 1,848,818 | A | 3/1932 | Becker |

(Continued)

FOREIGN PATENT DOCUMENTS

| | | |
|---|---|---|
| CA | 2775992 A1 | 5/2011 |
| CA | 2822857 | 7/2012 |

(Continued)

OTHER PUBLICATIONS

ASTM D5341-99(2010)e1, Standard Test Method for Measuring Coke Reactivity Index (CRI) and Coke Strength After Reaction (CSR), ASTM International, West Conshohocken, PA, 2010.

(Continued)

*Primary Examiner* — In Suk Bullock
*Assistant Examiner* — Jonathan L Pilcher
(74) *Attorney, Agent, or Firm* — Perkins Coie LLP

(57) ABSTRACT

A volatile matter sharing system includes a first stamp-charged coke oven, a second stamp-charged coke oven, a tunnel fluidly connecting the first stamp-charged coke oven to the second stamp-charged coke oven, and a control valve positioned in the tunnel for controlling fluid flow between the first stamp-charged coke oven and the second stamp-charged coke oven.

35 Claims, 9 Drawing Sheets

(56) References Cited

U.S. PATENT DOCUMENTS 1,955,962 A 4/1934 Jones
2,394,173 A 2/1946 Harris
2,424,012 A 7/1947 Bangham et al.
2,902,991 A 9/1959 Whitman
3,033,764 A 5/1962 Hannes
3,462,345 A 8/1969 Kernan
3,545,470 A 12/1970 Paton
3,616,408 A * 10/1971 Hickam ..... 204/410
3,630,852 A 12/1971 Nashan et al.
3,652,403 A 3/1972 Knappstein et al.
3,676,305 A 7/1972 Cremer
3,709,794 A 1/1973 Kinzler et al.
3,746,626 A 7/1973 Morrison, Jr.
3,748,235 A 7/1973 Pries
3,784,034 A 1/1974 Thompson
3,806,032 A 4/1974 Pries
3,836,161 A 9/1974 Buhl
3,839,156 A 10/1974 Jakobi et al.
3,844,900 A 10/1974 Schulte
3,857,758 A 12/1974 Mole
3,875,016 A 4/1975 Schmidt-Balve et al.
3,876,506 A 4/1975 Dix et al.
3,878,053 A 4/1975 Hyde
3,897,312 A 7/1975 Armour et al.
3,906,992 A 9/1975 Leach
3,912,091 A 10/1975 Thompson
3,917,458 A 11/1975 Polak
3,930,961 A 1/1976 Sustarsic et al.
3,957,591 A 5/1976 Riecker
3,959,084 A 5/1976 Price
3,963,582 A 6/1976 Helm et al.
3,969,191 A 7/1976 Bollenbach
3,984,289 A 10/1976 Sustarsic et al.
4,004,702 A 1/1977 Szendroi
4,004,983 A 1/1977 Pries
4,040,910 A 8/1977 Knappstein et al.
4,059,885 A 11/1977 Oldengott
4,067,462 A 1/1978 Thompson
4,083,753 A 4/1978 Rogers et al.
4,086,231 A 4/1978 Ikio
4,100,033 A 7/1978 Holter
4,111,757 A 9/1978 Ciarimboli
4,124,450 A 11/1978 MacDonald
4,141,796 A 2/1979 Clark et al.
4,145,195 A 3/1979 Knappstein et al.
4,147,230 A 4/1979 Ormond et al.
4,189,272 A 2/1980 Gregor et al.
4,194,951 A 3/1980 Pries
4,196,053 A 4/1980 Grohmann
4,211,608 A 7/1980 Kwasnoski et al.
4,213,489 A 7/1980 Cain
4,213,828 A 7/1980 Calderon
4,222,748 A 9/1980 Argo et al.
4,225,393 A 9/1980 Gregor et al.
4,235,830 A 11/1980 Bennett et al.
4,248,671 A 2/1981 Belding
4,249,997 A 2/1981 Schmitz
4,263,099 A 4/1981 Porter
4,285,772 A 8/1981 Kress
4,287,024 A 9/1981 Thompson
4,289,584 A 9/1981 Chuss et al.
4,289,585 A 9/1981 Wagener et al.
4,303,615 A 12/1981 Jarmell et al.
4,307,673 A 12/1981 Caughey
4,314,787 A 2/1982 Kwasnik et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,445,977 A 5/1984 Husher
4,446,018 A 5/1984 Cerwick
4,448,541 A 5/1984 Wirtschafter
4,452,749 A 6/1984 Kolvek et al.
4,459,103 A 7/1984 Gieskieng
4,469,446 A 9/1984 Goodboy
4,498,786 A 2/1985 Ruscheweyh
4,508,539 A 4/1985 Nakai
4,527,488 A 7/1985 Lindgren
4,568,426 A 2/1986 Orlando et al.
4,570,670 A 2/1986 Johnson
4,614,567 A 9/1986 Stahlherm et al.
4,645,513 A 2/1987 Kubota et al.
4,655,193 A 4/1987 Blacket
4,655,804 A 4/1987 Kercheval et al.
4,680,167 A 7/1987 Orlando et al.
4,704,195 A 11/1987 Janicka et al.
4,720,262 A 1/1988 Durr et al.
4,726,465 A 2/1988 Kwasnik et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,114,542 A * 5/1992 Childress et al. ..... 201/15
5,227,106 A 7/1993 Kolvek
5,228,955 A 7/1993 Westbrook
5,318,671 A 6/1994 Pruitt
5,670,025 A 9/1997 Baird
5,928,476 A 7/1999 Daniels
5,968,320 A 10/1999 Sprague
6,017,214 A 1/2000 Sturgulewski
6,059,932 A 5/2000 Sturgulewski
6,139,692 A 10/2000 Tamura et al.
6,152,668 A 11/2000 Knoch
6,187,148 B1 2/2001 Sturgulewski
6,189,819 B1 2/2001 Racine
6,290,494 B1 9/2001 Barkdoll
6,596,128 B2 7/2003 Westbrook
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
7,056,390 B2 6/2006 Fratello
7,077,892 B2 7/2006 Lee
7,314,060 B2 1/2008 Chen et al.
7,331,298 B2 2/2008 Taylor et al.
7,497,930 B2 * 3/2009 Barkdoll et al. ..... 201/41
7,611,609 B1 11/2009 Valia et al.
7,644,711 B2 1/2010 Creel
7,727,307 B2 6/2010 Winkler
7,803,627 B2 9/2010 Hodges
7,827,689 B2 11/2010 Crane et al.
7,998,316 B2 8/2011 Barkdoll et al.
8,071,060 B2 12/2011 Ukai et al.
8,079,751 B2 12/2011 Kapila et al.
8,152,970 B2 4/2012 Barkdoll et al.
8,236,142 B2 8/2012 Westbrook et al.
8,266,853 B2 9/2012 Bloom et al.
8,398,935 B2 3/2013 Howell, Jr. et al.
2002/0134659 A1 * 9/2002 Westbrook ..... 202/254
2006/0102420 A1 5/2006 Huber et al.
2008/0169578 A1 7/2008 Crane et al.
2008/0179165 A1 7/2008 Chen et al.
2008/0271985 A1 11/2008 Yamasaki
2009/0217576 A1 9/2009 Kim et al.
2009/0283395 A1 11/2009 Hippe
2010/0095521 A1 4/2010 Bertini et al.
2010/0115912 A1 5/2010 Worley et al.
2010/0287871 A1 11/2010 Bloom et al.
2011/0048917 A1 3/2011 Kim et al.
2011/0223088 A1 9/2011 Chang et al.

(56) References Cited

U.S. PATENT DOCUMENTS

| | | | |
|---|---|---|---|
| 2011/0253521 | A1 | 10/2011 | Kim |
| 2012/0024688 | A1 | 2/2012 | Barkdoll |
| 2012/0030998 | A1 | 2/2012 | Barkdoll et al. |
| 2012/0152720 | A1 | 6/2012 | Reichelt et al. |
| 2012/0228115 | A1 | 9/2012 | Westbrook |
| 2013/0216717 | A1 | 8/2013 | Rago et al. |
| 2013/0306462 | A1 | 11/2013 | Kim et al. |
| 2014/0033917 | A1 | 2/2014 | Rodgers et al. |
| 2014/0048402 | A1 | 2/2014 | Quanci et al. |
| 2014/0048405 | A1 | 2/2014 | Quanci et al. |
| 2014/0061018 | A1 | 3/2014 | Sarpen et al. |
| 2014/0083836 | A1 | 3/2014 | Quanci et al. |
| 2014/0182195 | A1 | 7/2014 | Quanci et al. |
| 2014/0182683 | A1 | 7/2014 | Quanci et al. |
| 2014/0183023 | A1 | 7/2014 | Quanci et al. |
| 2014/0183024 | A1 | 7/2014 | Chun et al. |
| 2014/0183026 | A1 | 7/2014 | Quanci et al. |
| 2014/0262139 | A1 | 9/2014 | Choi et al. |
| 2014/0262726 | A1 | 9/2014 | West et al. |
| 2015/0122629 | A1 | 5/2015 | Freimuth et al. |
| 2015/0247092 | A1 | 9/2015 | Quanci et al. |

FOREIGN PATENT DOCUMENTS

| | | | |
|---|---|---|---|
| CN | 2064363 | U | 10/1990 |
| CN | 1092457 | A | 9/1994 |
| CN | 1255528 | A | 6/2000 |
| CN | 1358822 | A | 7/2002 |
| CN | 2509188 | Y | 9/2002 |
| CN | 2528771 | Y | 1/2003 |
| CN | 1468364 | A | 1/2004 |
| CN | 2668641 | Y | 1/2005 |
| CN | 202226816 | U | 5/2012 |
| DE | 212176 | C | 7/1909 |
| DE | 3315738 | A1 | 11/1983 |
| DE | 3329367 | C1 | 11/1984 |
| DE | 19545736 | A1 | 6/1997 |
| DE | 19803455 | C1 | 8/1999 |
| DE | 10154785 | A1 | 5/2003 |
| DE | 102009031436 | | 1/2011 |
| DE | 102011052785 | B3 | 12/2012 |
| FR | 2339664 | A1 | 8/1977 |
| GB | 441784 | A | 1/1936 |
| GB | 606340 | A | 8/1948 |
| GB | 611524 | A | 11/1948 |
| GB | 725865 | A | 3/1955 |
| GB | 871094 | A | 6/1961 |
| JP | S50148405 | | 11/1975 |
| JP | 54054101 | A | 4/1979 |
| JP | 57051786 | A | 3/1982 |
| JP | 57051787 | A | 3/1982 |
| JP | 57083585 | A | 5/1982 |
| JP | 57090092 | A | 6/1982 |
| JP | 58091788 | A | 5/1983 |
| JP | 59051978 | A | 3/1984 |
| JP | 59053589 | A | 3/1984 |
| JP | 59071388 | A | 4/1984 |
| JP | 59108083 | A | 6/1984 |
| JP | 59145281 | A | 8/1984 |
| JP | 60004588 | A | 1/1985 |
| JP | 61106690 | A | 5/1986 |
| JP | 62011794 | A | 1/1987 |
| JP | 62285980 | A | 12/1987 |
| JP | 01103694 | A | 4/1989 |
| JP | 01249886 | A | 10/1989 |
| JP | H0319127 | A | 1/1991 |
| JP | 03197588 | A | 8/1991 |
| JP | 07188668 | A | 7/1995 |
| JP | 07216357 | A | 8/1995 |
| JP | 08127778 | A | 5/1996 |
| JP | 2001200258 | A | 7/2001 |
| JP | 2002106941 | A | 4/2002 |
| JP | 200341258 | A | 2/2003 |
| JP | 2003071313 | A | 3/2003 |
| JP | 04159392 | A | 10/2008 |
| JP | 2009144121 | A | 7/2009 |
| JP | 2012102302 | A | 5/2012 |
| KR | 960008754 | Y1 | 10/1996 |
| KR | 1019990054426 | A | 7/1999 |
| KR | 100296700 | B1 | 10/2001 |
| KR | 100797852 | B1 | 1/2008 |
| KR | 1020110010452 | A | 2/2011 |
| KR | 101318388 | B1 | 10/2013 |
| WO | 9012074 | A1 | 10/1990 |
| WO | 9945083 | A1 | 9/1999 |
| WO | 2007103649 | A2 | 9/2007 |
| WO | 2008034424 | A1 | 3/2008 |
| WO | 2010107513 | A1 | 9/2010 |
| WO | WO-2011000447 | A1 | 1/2011 |
| WO | 2012029979 | A1 | 3/2012 |
| WO | WO-2013023872 | A1 | 2/2013 |

OTHER PUBLICATIONS

Clean coke process: process development studies by USS Engineers and Consultants, Inc., Wisconsin Tech Search, request date Oct. 5, 2011, 17 pages.

Crelling, et al., "Effects of Weathered Coal on Coking Properties and Coke Quality", Fuel, 1979, vol. 58, Issue 7, pp. 542-546.

Database WPI, Week 199115, Thomson Scientific, Lond, GB; AN 1991-107552.

Diez, et al., "Coal for Metallurgical Coke Production: Predictions of Coke Quality and Future Requirements for Cokemaking", International Journal of Coal Geology, 2002, vol. 50, Issue 1-4, pp. 389-412.

Rose, Harold J., "The Selection of Coals for the Manufacture of Coke," American Institute of Mining and Metallurgical Engineers, Feb. 1926, 8 pages.

International Search Report and Written Opinion of International Application No. PCT/US2013/054721; Date of Mailing: Nov. 19, 2013; 17 pages.

JP 03-197588, Inoqu Keizo et al., Method and Equipment for Boring Degassing Hole in Coal Charge in Coke Oven, Japanese Patent (Abstract Only) Aug. 28, 1991.

JP 04-159392, Inoue Keizo et al., Method and Equipment for Opening Hole for Degassing of Coal Charge in Coke Oven, Japanese Patent (Abstract Only) Jun. 2, 1992.

U.S. Appl. No. 14/839,384, filed Aug. 28, 2015, Quanci et al.

U.S. Appl. No. 14/839,493, filed Aug. 28, 2015, Quanci et al.

U.S. Appl. No. 14/839,551, filed Aug. 28, 2015, Quanci et al.

U.S. Appl. No. 14/839,588, filed Aug. 28, 2015, Quanci et al.

U.S. Appl. No. 14/865,581, filed Sep. 25, 2015, Sarpen et al.

* cited by examiner

METHOD AND APPARATUS FOR VOLATILE MATTER SHARING IN STAMP-CHARGED COKE OVENS

BACKGROUND OF THE INVENTION

The present invention relates generally to the field of coke plants for producing coke from coal. Coke is a solid carbon fuel and carbon source used to melt and reduce iron ore in the production of steel. In one process, known as the "Thompson Coking Process," coke is produced by batch feeding pulverized coal to an oven that is sealed and heated to very high temperatures for 24 to 48 hours under closely controlled atmospheric conditions. Coking ovens have been used for many years to covert coal into metallurgical coke. During the coking process, finely crushed coal is heated under controlled temperature conditions to devolatilize the coal and form a fused mass of coke having a predetermined porosity and strength. Because the production of coke is a batch process, multiple coke ovens are operated simultaneously.

The melting and fusion process undergone by the coal particles during the heating process is an important part of the coking process. The degree of melting and degree of assimilation of the coal particles into the molten mass determine the characteristics of the coke produced. In order to produce the strongest coke from a particular coal or coal blend, there is an optimum ratio of reactive to inert entities in the coal. The porosity and strength of the coke are important for the ore refining process and are determined by the coal source and/or method of coking.

Coal particles or a blend of coal particles are charged into hot ovens, and the coal is heated in the ovens in order to remove volatiles from the resulting coke. The coking process is highly dependent on the oven design, the type of coal, and conversion temperature used. Ovens are adjusted during the coking process so that each charge of coal is coked out in approximately the same amount of time. Once the coal is "coked out" or fully coked, the coke is removed from the oven and quenched with water to cool it below its ignition temperature. Alternatively, the coke is dry quenched with an inert gas. The quenching operation must also be carefully controlled so that the coke does not absorb too much moisture. Once it is quenched, the coke is screened and loaded into rail cars or trucks for shipment.

Because coal is fed into hot ovens, much of the coal feeding process is automated. In slot-type or vertical ovens, the coal is typically charged through slots or openings in the top of the ovens. Such ovens tend to be tall and narrow. Horizontal non-recovery or heat recovery type coking ovens are also used to produce coke. In the non-recovery or heat recovery type coking ovens, conveyors are used to convey the coal particles horizontally into the ovens to provide an elongate bed of coal.

As the source of coal suitable for forming metallurgical coal ("coking coal") has decreased, attempts have been made to blend weak or lower quality coals ("non-coking coal") with coking coals to provide a suitable coal charge for the ovens. One way to combine non-coking and coking coals is to use compacted or stamp-charged coal. The coal may be compacted before or after it is in the oven. In some embodiments, a mixture of non-coking and coking coals is compacted to greater than fifty pounds per cubic foot in order to use non-coking coal in the coke making process. As the percentage of non-coking coal in the coal mixture is increased, higher levels of coal compaction are required (e.g., up to about sixty-five to seventy-five pounds per cubic foot). Commercially, coal is typically compacted to about 1.15 to 1.2 specific gravity (sg) or about 70-75 pounds per cubic foot.

Horizontal Heat Recovery (HHR) ovens have a unique environmental advantage over chemical byproduct ovens based upon the relative operating atmospheric pressure conditions inside the oven. HHR ovens operate under negative pressure whereas chemical byproduct ovens operate at a slightly positive atmospheric pressure. Both oven types are typically constructed of refractory bricks and other materials in which creating a substantially airtight environment can be a challenge because small cracks can form in these structures during day-to-day operation. Chemical byproduct ovens are kept at a positive pressure to avoid oxidizing recoverable products and overheating the ovens. Conversely, HHR ovens are kept at a negative pressure, drawing in air from outside the oven to oxidize the coal volatiles and to release the heat of combustion within the oven. These opposite operating pressure conditions and combustion systems are important design differences between HHR ovens and chemical byproduct ovens. It is important to minimize the loss of volatile gases to the environment, so the combination of positive atmospheric conditions and small openings or cracks in chemical byproduct ovens allow raw coke oven gas ("COG") and hazardous pollutants to leak into the atmosphere. Conversely, the negative atmospheric conditions and small openings or cracks in the HHR ovens or locations elsewhere in the coke plant simply allow additional air to be drawn into the oven or other locations in the coke plant so that the negative atmospheric conditions resist the loss of COG to the atmosphere.

SUMMARY OF THE INVENTION

One embodiment of the invention relates to a volatile matter sharing system including a first stamp-charged coke oven, a second stamp-charged coke oven, a tunnel fluidly connecting the first stamp-charged coke oven to the second stamp-charged coke oven, and a control valve positioned in the tunnel for controlling fluid flow between the first stamp-charged coke oven and the second stamp-charged coke oven.

Another embodiment of the invention relates to a volatile matter sharing system including a first stamp-charged coke oven and a second stamp-charged coke oven, each of the stamp-charged coke ovens including an oven chamber, a sole flue, a downcomer channel fluidly connecting the oven chamber and the sole flue, an uptake duct in fluid communication with the sole flue, the uptake duct configured to receive exhaust gases from the oven chamber, an automatic uptake damper in the uptake duct and configured to be positioned in any one of a plurality of positions including fully open and fully closed according to a position instruction to control an oven draft in the oven chamber, and a sensor configured to detect an operating condition of the stamp-charged coke oven, a tunnel fluidly connecting the first stamp-charged coke oven to the second stamp-charged coke oven, a control valve positioned in the tunnel and configured to be positioned at any one of a plurality of positions including fully open and fully closed according to a position instruction to control fluid flow between the first stamp-charged coke oven and the second stamp-charged coke oven, and a controller in communication with the automatic uptake dampers, the control valve, and the sensors, the controller configured to provide the position instruction to each of the automatic uptake dampers and the control valve in response to the operating conditions detected by the sensors.

Another embodiment of the invention relates to a method of sharing volatile matter between two stamp-charged coke ovens, the method including charging a first coke oven with stamp-charged coal, charging a second coke oven with stamp-charged coal, operating the second coke oven to produce volatile matter and at a second coke oven temperature at least equal to a target coking temperature, operating the first coke oven to produce volatile matter and at a first coke oven temperature below the target coking temperature, transferring volatile matter from the second coke oven to the first coke oven, combusting the transferred volatile matter in the first coke oven to increase the first coke oven temperature to at least the target coking temperature, and continue operating the second coke oven such that the second coke oven temperature is at least at the target coking temperature.

Another embodiment of the invention relates to a method of sharing volatile matter between two stamp-charged coke ovens, the method including charging a first coke oven with stamp-charged coal, charging a second coke oven with stamp-charged coal, operating the first coke oven to produce volatile matter, operating the first coke oven to produce volatile matter, detecting a first coke oven temperature indicative of an overheat condition in the first coke oven, and transferring volatile matter from the first coke oven to the second coke oven to reduce the detected first coke oven temperature below the overheat condition.

DETAILED DESCRIPTION OF THE PREFERRED EMBODIMENTS

The contents of U.S. Pat. No. 6,596,128 and U.S. Pat. No. 7,497,930 are herein incorporated by reference.

Figure 1:
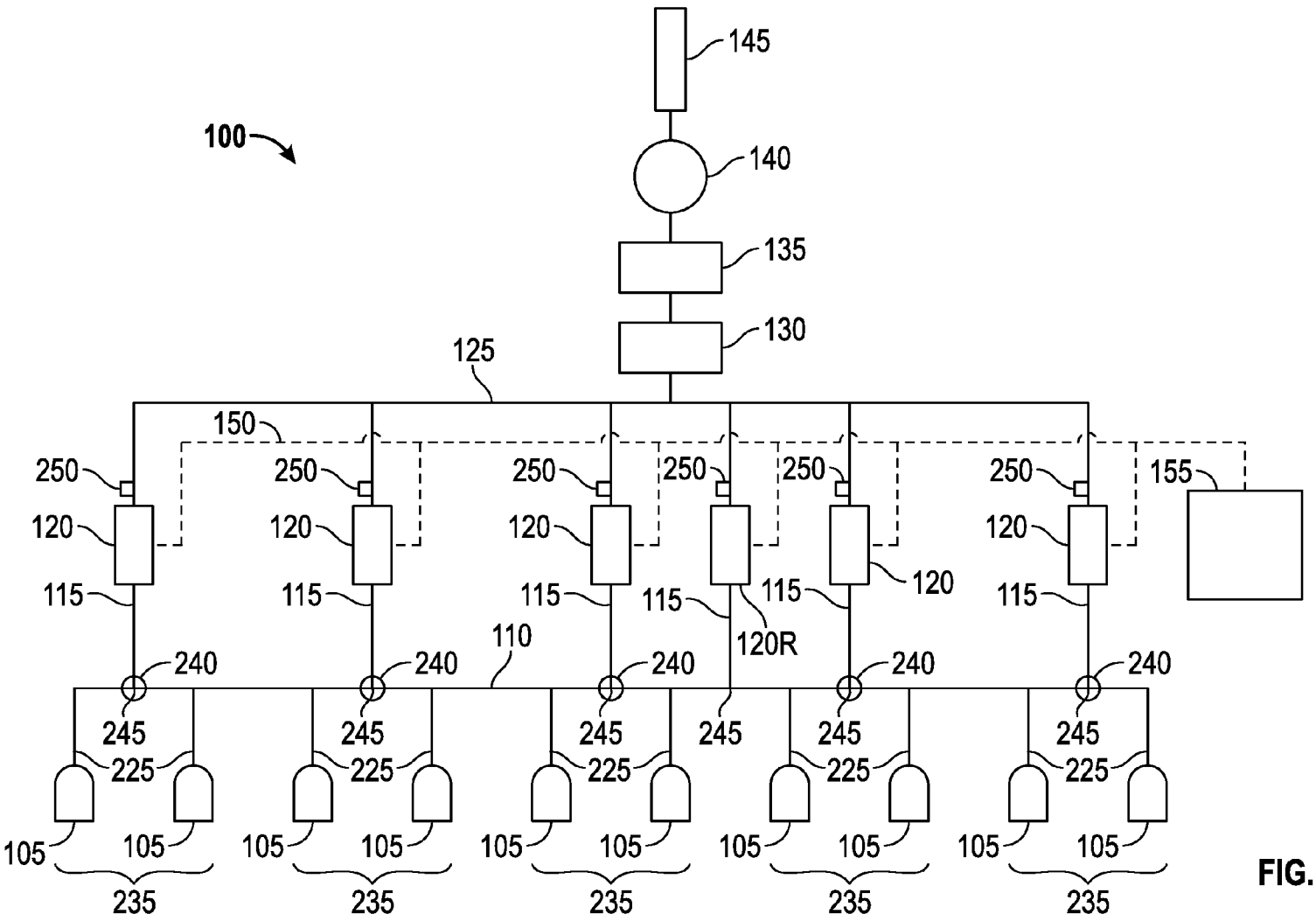
FIG. 1 is a schematic drawing of a horizontal heat recovery (HHR) coke plant, shown according to an exemplary embodiment.

Referring to FIG. 1, a HHR coke plant 100 is illustrated which produces coke from coal in a reducing environment. In general, the HHR coke plant 100 comprises at least one oven 105, along with heat recovery steam generators (HRSGs) 120 and an air quality control system 130 (e.g. an exhaust or flue gas desulfurization (FGD) system) both of which are positioned fluidly downstream from the ovens and both of which are fluidly connected to the ovens by suitable ducts. The HHR coke plant 100 preferably includes a plurality of ovens 105 and a common tunnel 110 fluidly connecting each of the ovens 105 to a plurality of HRSGs 120. One or more cross-over ducts 115 fluidly connects the common tunnel 110 to the HRSGs 120. A cooled gas duct 125 transports the cooled gas from the HRSG to the flue gas desulfurization (FGD) system 130. Fluidly connected and further downstream are a baghouse 135 for collecting particulates, at least one draft fan 140 for controlling air pressure within the system, and a main gas stack 145 for exhausting cooled, treated exhaust to the environment. Steam lines 150 interconnect the HRSG and a cogeneration plant 155 so that the recovered heat can be utilized. As illustrated in FIG. 1, each "oven" shown represents ten actual ovens.

Figure 2:
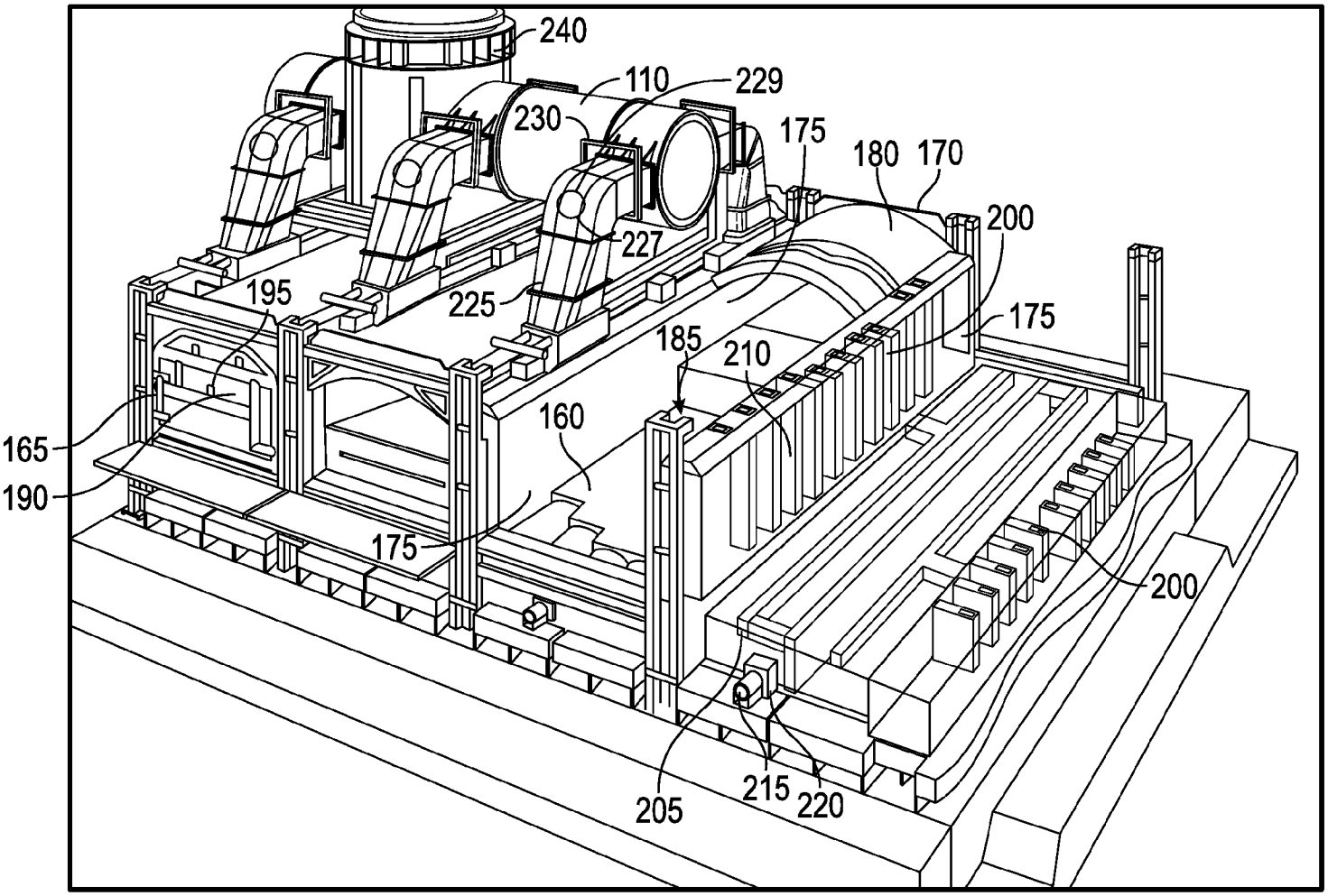
FIG. 2 is a perspective view of portion of the HHR coke plant of FIG. 1, with several sections cut away.
Figure 3:
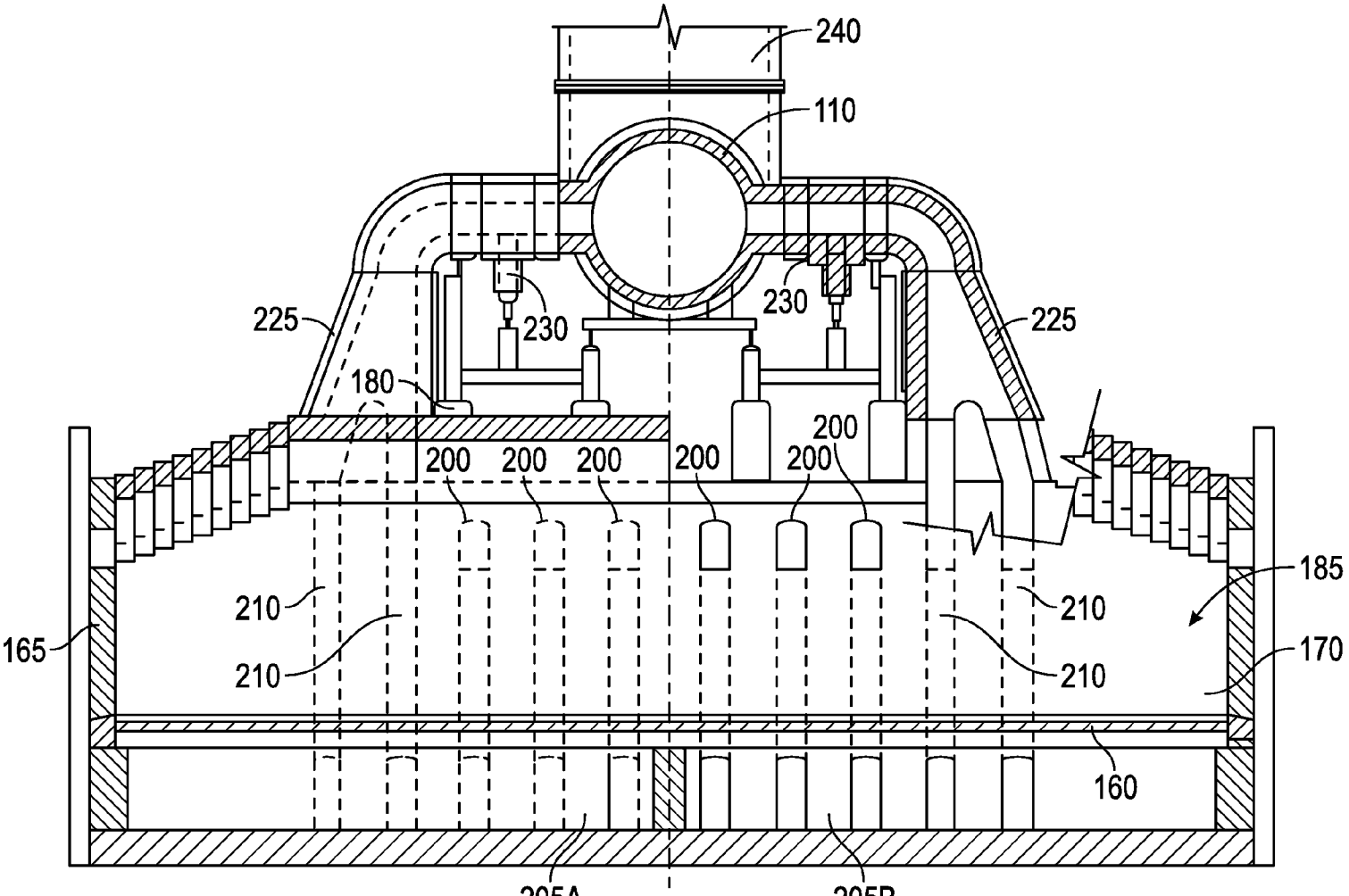
FIG. 3 is a sectional view of an HHR coke oven.

More structural detail of each oven 105 is shown in FIG. 2 wherein various portions of four coke ovens 105 are illustrated with sections cut away for clarity and also in FIG. 3. Each oven 105 comprises an open cavity preferably defined by a floor 160, a front door 165 forming substantially the entirety of one side of the oven, a rear door 170 preferably opposite the front door 165 forming substantially the entirety of the side of the oven opposite the front door, two sidewalls 175 extending upwardly from the floor 160 intermediate the front 165 and rear 170 doors, and a crown 180 which forms the top surface of the open cavity of an oven chamber 185. Controlling air flow and pressure inside the oven chamber 185 can be critical to the efficient operation of the coking cycle and therefore the front door 165 includes one or more primary air inlets 190 that allow primary combustion air into the oven chamber 185. Each primary air inlet 190 includes a primary air damper 195 which can be positioned at any of a number of positions between fully open and fully closed to vary the amount of primary air flow into the oven chamber 185. Alternatively, the one or more primary air inlets 190 are formed through the crown 180. In operation, volatile gases emitted from the coal positioned inside the oven chamber 185 collect in the crown and are drawn downstream in the overall system into downcomer channels 200 formed in one or both sidewalls 175. The downcomer channels fluidly connect the oven chamber 185 with a sole flue 205 positioned beneath the over floor 160. The sole flue 205 forms a circuitous path beneath the oven floor 160. Volatile gases emitted from the coal can be combusted in the sole flue 205 thereby generating heat to support the reduction of coal into coke. The downcomer channels 200 are fluidly connected to chimneys or uptake channels 210 formed in one or both sidewalls 175. A secondary air inlet 215 is provided between the sole flue 205 and atmosphere and the secondary air inlet 215 includes a secondary air damper 220 that can be positioned at any of a number of positions between fully open and fully closed to vary the amount of secondary air flow into the sole flue 205. The uptake channels 210 are fluidly connected to the common tunnel 110 by one or more uptake ducts 225. A tertiary air inlet 227 is provided between the uptake duct 225 and atmosphere. The tertiary air inlet 227 includes a tertiary air damper 229 which can be positioned at any of a number of positions between fully open and fully closed to vary the amount of tertiary air flow into the uptake duct 225.

In order to provide the ability to control gas flow through the uptake ducts 225 and within ovens 105, each uptake duct 225 also includes an uptake damper 230. The uptake damper 230 can be positioned at number of positions between fully open and fully closed to vary the amount of oven draft in the oven 105. As used herein, "draft" indicates a negative pressure relative to atmosphere. For example a draft of 0.1 inches of water indicates a pressure 0.1 inches of water below atmospheric pressure. Inches of water is a non-SI unit for pressure and is conventionally used to describe the draft at various locations in a coke plant. If a draft is increased or otherwise made larger, the pressure moves further below atmospheric pressure. If a draft is decreased, drops, or is otherwise made smaller or lower, the pressure moves towards atmospheric pressure. By controlling the oven draft with the uptake damper 230, the air flow into the oven from the air inlets 190, 215, 227 as well as air leaks into the oven 105 can be controlled. Typically, as shown in FIG. 3, an oven 105 includes two uptake ducts 225 and two uptake dampers 230, but the use of two uptake ducts and two uptake dampers is not a necessity, a system can be designed to use just one or more than two uptake ducts and two uptake dampers.

As shown in FIG. 1, a sample HHR coke plant 100 includes a number of ovens 105 that are grouped into oven blocks 235. The illustrated HHR coke plant 100 includes five oven blocks 235 of twenty ovens each, for a total of one hundred ovens. All of the ovens 105 are fluidly connected by at least one uptake duct 225 to the common tunnel 110 which is in turn fluidly connected to each HRSG 120 by a crossover duct 115. Each oven block 235 is associated with a particular crossover duct 115. The exhaust gases from each oven 105 in an oven block 235 flow through the common tunnel 110 to the crossover duct 115 associated with each respective oven block 235. Half of the ovens in an oven block 235 are located on one side of an intersection 245 of the common tunnel 110 and a crossover duct 115 and the other half of the ovens in the oven block 235 are located on the other side of the intersection 245

A HRSG valve or damper 250 associated with each HRSG 120 (shown in FIG. 1) is adjustable to control the flow of exhaust gases through the HRSG 120. The HRSG valve 250 can be positioned on the upstream or hot side of the HRSG 120, but is preferably positioned on the downstream or cold side of the HRSG 120. The HRSG valves 250 are variable to a number of positions between fully opened and fully closed and the flow of exhaust gases through the HRSGs 120 is controlled by adjusting the relative position of the HRSG valves 250.

In operation, coke is produced in the ovens 105 by first loading coal into the oven chamber 185, heating the coal in an oxygen depleted environment, driving off the volatile fraction of coal and then oxidizing the volatiles within the oven 105 to capture and utilize the heat given off. The coal volatiles are oxidized within the ovens over an approximately 48-hour coking cycle, and release heat to regeneratively drive the carbonization of the coal to coke. The coking cycle begins when the front door 165 is opened and coal is charged onto the oven floor 160. The coal on the oven floor 160 is known as the coal bed. Heat from the oven (due to the previous coking cycle) starts the carbonization cycle. Preferably, no additional fuel other than that produced by the coking process is used. Roughly half of the total heat transfer to the coal bed is radiated down onto the top surface of the coal bed from the luminous flame of the coal bed and the radiant oven crown 180. The remaining half of the heat is transferred to the coal bed by conduction from the oven floor 160 which is convectively heated from the volatilization of gases in the sole flue 205. In this way, a carbonization process "wave" of plastic flow of the coal particles and formation of high strength cohesive coke proceeds from both the top and bottom boundaries of the coal bed at the same rate, preferably meeting at the center of the coal bed after about 45-48 hours.

Accurately controlling the system pressure, oven pressure, flow of air into the ovens, flow of air into the system, and flow of gases within the system is important for a wide range of reasons including to ensure that the coal is fully coked, effectively extract all heat of combustion from the volatile gases, effectively control the level of oxygen within the oven chamber 185 and elsewhere in the coke plant 100, controlling the particulates and other potential pollutants, and converting the latent heat in the exhaust gases to steam which can be harnessed for generation of steam and/or electricity. Preferably, each oven 105 is operated at negative pressure so air is drawn into the oven during the reduction process due to the pressure differential between the oven 105 and atmosphere. Primary air for combustion is added to the oven chamber 185 to partially oxidize the coal volatiles, but the amount of this primary air is preferably controlled so that only a portion of the volatiles released from the coal are combusted in the oven chamber 185 thereby releasing only a fraction of their enthalpy of combustion within the oven chamber 185. The primary air is introduced into the oven chamber 185 above the coal bed through the primary air inlets 190 with the amount of primary air controlled by the primary air dampers 195. The primary air dampers 195 can be used to maintain the desired operating temperature inside the oven chamber 185. The partially combusted gases pass from the oven chamber 185 through the downcomer channels 200 into the sole flue 205 where secondary air is added to the partially combusted gases. The secondary air is introduced through the secondary air inlet 215 with the amount of secondary air controlled by the secondary air damper 220. As the secondary air is introduced, the partially combusted gases are more fully combusted in the sole flue 205 extracting the remaining enthalpy of combustion which is conveyed through the oven floor 160 to add heat to the oven chamber 185. The fully or nearly-fully combusted exhaust gases exit the sole flue 205 through the uptake channels 210 and then flow into the uptake duct 225. Tertiary air is added to the exhaust gases via the tertiary air inlet 227 with the amount of tertiary air controlled by the tertiary air damper 229 so that any remaining fraction of uncombusted gases in the exhaust gases are oxidized downstream of the tertiary air inlet 2217.

At the end of the coking cycle, the coal has coked out and has carbonized to produce coke. Green coke is coal that is not fully coked. The coke is preferably removed from the oven 105 through the rear door 170 utilizing a mechanical extraction system. Finally, the coke is quenched (e.g. wet or dry quenched) and sized before delivery to a user.

Figure 4:
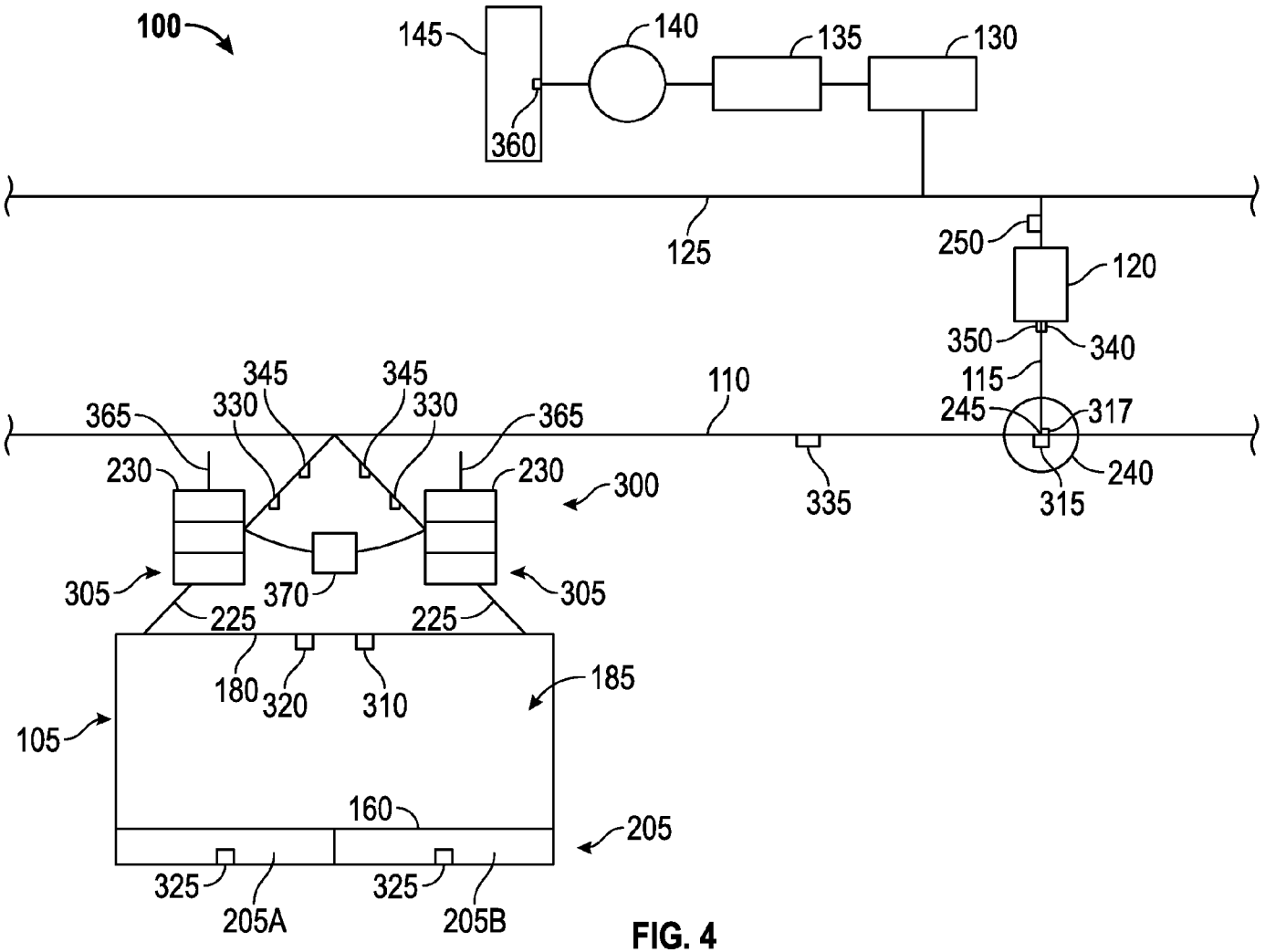
FIG. 4 is a schematic view of a portion of the coke plant of FIG. 1.

FIG. 4 illustrates a portion of the coke plant 100 including an automatic draft control system 300. The automatic draft control system 300 includes an automatic uptake damper 305 that can be positioned at any one of a number of positions between fully open and fully closed to vary the amount of oven draft in the oven 105. The automatic uptake damper 305 is controlled in response to operating conditions (e.g., pressure or draft, temperature, oxygen concentration, gas flow rate) detected by at least one sensor. The automatic control system 300 can include one or more of the sensors discussed below or other sensors configured to detect operating conditions relevant to the operation of the coke plant 100.

An oven draft sensor or oven pressure sensor 310 detects a pressure that is indicative of the oven draft and the oven draft sensor 310 can be located in the oven crown 180 or elsewhere in the oven chamber 185. Alternatively, the oven draft sensor 310 can be located at either of the automatic uptake dampers 305, in the sole flue 205, at either oven door 165 or 170, or in the common tunnel 110 near above the coke oven 105. In one embodiment, the oven draft sensor 310 is located in the top of the oven crown 180. The oven draft sensor 310 can be located flush with the refractory brick lining of the oven crown 180 or could extend into the oven chamber 185 from the oven crown 180. A bypass exhaust stack draft sensor 315 detects a pressure that is indicative of the draft at the bypass exhaust stack 240 (e.g., at the base of the bypass exhaust stack 240). In some embodiments, the bypass exhaust stack draft sensor 315 is located at the intersection 245. Additional draft sensors can be positioned at other locations in the coke plant 100. For example, a draft sensor in the common tunnel could be used to detect a common tunnel draft indicative of the oven draft in multiple ovens proximate the draft sensor. An intersection draft sensor 317 detects a pressure that is indicative of the draft at one of the intersections 245.

An oven temperature sensor 320 detects the oven temperature and can be located in the oven crown 180 or elsewhere in the oven chamber 185. A sole flue temperature sensor 325 detects the sole flue temperature and is located in the sole flue 205. In some embodiments, the sole flue 205 is divided into two labyrinths 205A and 205B with each labyrinth in fluid communication with one of the oven's two uptake ducts 225. A flue temperature sensor 325 is located in each of the sole flue labyrinths so that the sole flue temperature can be detected in each labyrinth. An uptake duct temperature sensor 330 detects the uptake duct temperature and is located in the uptake duct 225. A common tunnel temperature sensor 335 detects the common tunnel temperature and is located in the common tunnel 110. A HRSG inlet temperature sensor 340 detects the HRSG inlet temperature and is located at or near the inlet of the HRSG 120. Additional temperature sensors can be positioned at other locations in the coke plant 100.

An uptake duct oxygen sensor 345 is positioned to detect the oxygen concentration of the exhaust gases in the uptake duct 225. An HRSG inlet oxygen sensor 350 is positioned to detect the oxygen concentration of the exhaust gases at the inlet of the HRSG 120. A main stack oxygen sensor 360 is positioned to detect the oxygen concentration of the exhaust gases in the main stack 145 and additional oxygen sensors can be positioned at other locations in the coke plant 100 to provide information on the relative oxygen concentration at various locations in the system.

A flow sensor detects the gas flow rate of the exhaust gases. For example, a flow sensor can be located downstream of each of the HRSGs 120 to detect the flow rate of the exhaust gases exiting each HRSG 120. This information can be used to balance the flow of exhaust gases through each HRSG 120 by adjusting the HRSG dampers 250. Additional flow sensors can be positioned at other location sin the coke plant 100 to provide information on the gas flow rate at various locations in the system.

Additionally, one or more draft or pressure sensors, temperature sensors, oxygen sensors, flow sensors, and/or other sensors may be used at the air quality control system 130 or other locations downstream of the HRSGs 120.

It can be important to keep the sensors clean. One method of keeping a sensor clean is to periodically remove the sensor and manually clean it. Alternatively, the sensor can periodically subjected to a burst, blast, or flow of a high pressure gas to remove build up at the sensor. As a further alternatively, a small continuous gas flow can be provided to continually clean the sensor.

The automatic uptake damper 305 includes the uptake damper 230 and an actuator 365 configured to open and close the uptake damper 230. For example, the actuator 365 can be a linear actuator or a rotational actuator. The actuator 365 allows the uptake damper 230 to be infinitely controlled between the fully open and the fully closed positions. The actuator 365 moves the uptake damper 230 amongst these positions in response to the operating condition or operating conditions detected by the sensor or sensors included in the automatic draft control system 300. This provides much greater control than a conventional uptake damper. A conventional uptake damper has a limited number of fixed positions between fully open and fully closed and must be manually adjusted amongst these positions by an operator.

The uptake dampers 230 are periodically adjusted to maintain the appropriate oven draft (e.g., at least 0.1 inches of water) which changes in response to many different factors within the ovens or the hot exhaust system. When the common tunnel 110 has a relatively low common tunnel draft (i.e., closer to atmospheric pressure than a relatively high draft), the uptake damper 230 can be opened to increase the oven draft to ensure the oven draft remains at or above 0.1 inches of water. When the common tunnel 110 has a relatively high common tunnel draft, the uptake damper 230 can be closed to decrease the oven draft, thereby reducing the amount of air drawn into the oven chamber 185.

With conventional uptake dampers, the uptake dampers are manually adjusted and therefore optimizing the oven draft is part art and part science, a product of operator experience and awareness. The automatic draft control system 300 described herein automates control of the uptake dampers 230 and allows for continuous optimization of the position of the uptake dampers 230 thereby replacing at least some of the necessary operator experience and awareness. The automatic draft control system 300 can be used to maintain an oven draft at a targeted oven draft (e.g., at least 0.1 inches of water), control the amount of excess air in the oven 105, or achieve other desirable effects by automatically adjusting the position of the uptake damper 230. Without automatic control, it would be difficult if not impossible to manually adjust the uptake dampers 230 as frequently as would be required to maintain the oven draft of at least 0.1 inches of water without allowing the pressure in the oven to drift to positive. Typically, with manual control, the target oven draft is greater than 0.1 inches of water, which leads to more air leakage into the coke oven 105. For a conventional uptake damper, an operator monitors various oven temperatures and visually observes the coking process in the coke oven to determine when to and how much to adjust the uptake damper. The operator has no specific information about the draft (pressure) within the coke oven.

The actuator 365 positions the uptake damper 230 based on position instructions received from a controller 370. The position instructions can be generated in response to the draft, temperature, oxygen concentration, or gas flow rate detected by one or more of the sensors discussed above, control algorithms that include one or more sensor inputs, or other control algorithms. The controller 370 can be a discrete controller associated with a single automatic uptake damper 305 or multiple automatic uptake dampers 305, a centralized controller (e.g., a distributed control system or a programmable logic control system), or a combination of the two. In some embodiments, the controller 370 utilizes proportional-integral-derivative ("PID") control.

The automatic draft control system 300 can, for example, control the automatic uptake damper 305 of an oven 105 in response to the oven draft detected by the oven draft sensor 310. The oven draft sensor 310 detects the oven draft and outputs a signal indicative of the oven draft to the controller 370. The controller 370 generates a position instruction in response to this sensor input and the actuator 365 moves the uptake damper 230 to the position required by the position instruction. In this way, the automatic control system 300 can be used to maintain a targeted oven draft (e.g., at least 0.1 inches of water). Similarly, the automatic draft control system 300 can control the automatic uptake dampers 305, the HRSG dampers 250, and the draft fan 140, as needed, to maintain targeted drafts at other locations within the coke plant 100 (e.g., a targeted intersection draft or a targeted common tunnel draft). The automatic draft control system 300 can be placed into a manual mode to allow for manual adjustment of the automatic uptake dampers 305, the HRSG dampers, and/or the draft fan 140, as needed. Preferably, the automatic draft control system 300 includes a manual mode timer and upon expiration of the manual mode timer, the automatic draft control system 300 returns to automatic mode.

In some embodiments, the signal generated by the oven draft sensor 310 that is indicative of the detected pressure or draft is time averaged to achieve a stable pressure control in the coke oven 105. The time averaging of the signal can be accomplished by the controller 370. Time averaging the pressure signal helps to filter out normal fluctuations in the pressure signal and to filter out noise. Typically, the signal could be averaged over 30 seconds, 1 minute, 5 minutes, or over at least 10 minutes. In one embodiment, a rolling time average of the pressure signal is generated by taking 200 scans of the detected pressure at 50 milliseconds per scan. The larger the difference in the time-averaged pressure signal and the target oven draft, the automatic draft control system 300 enacts a larger change in the damper position to achieve the desired target draft. In some embodiments, the position instructions provided by the controller 370 to the automatic uptake damper 305 are linearly proportional to the difference in the time-averaged pressure signal and the target oven draft. In other embodiments, the position instructions provided by the controller 370 to the automatic uptake damper 305 are non-linearly proportional to the difference in the time-averaged pressure signal and the target oven draft. The other sensors previously discussed can similarly have time-averaged signals.

The automatic draft control system 300 can be operated to maintain a constant time-averaged oven draft within a specific tolerance of the target oven draft throughout the coking cycle. This tolerance can be, for example, +/−0.05 inches of water, +/−0.02 inches of water, or +/−0.01 inches of water.

The automatic draft control system 300 can also be operated to create a variable draft at the coke oven by adjusting the target oven draft over the course of the coking cycle. The target oven draft can be stepwise reduced as a function of the elapsed time of the coking cycle. In this manner, using a 48-hour coking cycle as an example, the target draft starts out relatively high (e.g. 0.2 inches of water) and is reduced every 12 hours by 0.05 inches of water so that the target oven draft is 0.2 inches of water for hours 1-12 of the coking cycle, 0.15 inches of water for hours 12-24 of the coking cycle, 0.01 inches of water for hours 24-36 of the coking cycle, and 0.05 inches of water for hours 36-48 of the coking cycle. Alternatively, the target draft can be linearly decreased throughout the coking cycle to a new, smaller value proportional to the elapsed time of the coking cycle.

As an example, if the oven draft of an oven 105 drops below the targeted oven draft (e.g., 0.1 inches of water) and the uptake damper 230 is fully open, the automatic draft control system 300 would increase the draft by opening at least one HRSG damper 250 to increase the oven draft. Because this increase in draft downstream of the oven 105 affects more than one oven 105, some ovens 105 might need to have their uptake dampers 230 adjusted (e.g., moved towards the fully closed position) to maintain the targeted oven draft (i.e., regulate the oven draft to prevent it from becoming too high). If the HRSG damper 250 was already fully open, the automatic damper control system 300 would need to have the draft fan 140 provide a larger draft. This increased draft downstream of all the HRSGs 120 would affect all the HRSG 120 and might require adjustment of the HRSG dampers 250 and the uptake dampers 230 to maintain target drafts throughout the coke plant 100.

As another example, the common tunnel draft can be minimized by requiring that at least one uptake damper 230 is fully open and that all the ovens 105 are at least at the targeted oven draft (e.g. 0.1 inches of water) with the HRSG dampers 250 and/or the draft fan 140 adjusted as needed to maintain these operating requirements.

As another example, the coke plant 100 can be run at variable draft for the intersection draft and/or the common tunnel draft to stabilize the air leakage rate, the mass flow, and the temperature and composition of the exhaust gases (e.g. oxygen levels), among other desirable benefits. This is accomplished by varying the intersection draft and/or the common tunnel draft from a relatively high draft (e.g. 0.8 inches of water) when the coke ovens 105 are pushed and reducing gradually to a relatively low draft (e.g. 0.4 inches of water), that is, running at relatively high draft in the early part of the coking cycle and at relatively low draft in the late part of the coking cycle. The draft can be varied continuously or in a step-wise fashion.

As another example, if the common tunnel draft decreases too much, the HRSG damper 250 would open to raise the common tunnel draft to meet the target common tunnel draft at one or more locations along the common tunnel 110 (e.g., 0.7 inches water). After increasing the common tunnel draft by adjusting the HRSG damper 250, the uptake dampers 230 in the affected ovens 105 might be adjusted (e.g., moved towards the fully closed position) to maintain the targeted oven draft in the affected ovens 105 (i.e., regulate the oven draft to prevent it from becoming too high).

As another example, the automatic draft control system 300 can control the automatic uptake damper 305 of an oven 105 in response to the oven temperature detected by the oven temperature sensor 320 and/or the sole flue temperature detected by the sole flue temperature sensor or sensors 325. Adjusting the automatic uptake damper 305 in response to the oven temperature and or the sole flue temperature can optimize coke production or other desirable outcomes based on specified oven temperatures. When the sole flue 205 includes two labyrinths 205A and 205B, the temperature balance between the two labyrinths 205A and 205B can be controlled by the automatic draft control system 300. The automatic uptake damper 305 for each of the oven's two uptake ducts 225 is controlled in response to the sole flue temperature detected by the sole flue temperature sensor 325 located in labyrinth 205A or 205B associated with that uptake duct 225. The controller 370 compares the sole flue temperature detected in each of the labyrinths 205A and 205B and generates positional instructions for each of the two automatic uptake dampers 305 so that the sole flue temperature in each of the labyrinths 205A and 205B remains within a specified temperature range.

In some embodiments, the two automatic uptake dampers 305 are moved together to the same positions or synchronized. The automatic uptake damper 305 closest to the front door 165 is known as the "push-side" damper and the automatic uptake damper closet to the rear door 170 is known as the "coke-side" damper. In this manner, a single oven draft pressure sensor 310 provides signals and is used to adjust both the push- and coke-side automatic uptake dampers 305 identically. For example, if the position instruction from the controller to the automatic uptake dampers 305 is at 60% open, both push- and coke-side automatic uptake dampers 305 are positioned at 60% open. If the position instruction from the controller to the automatic uptake dampers 305 is 8 inches open, both push- and coke-side automatic uptake dampers 305 are 8 inches open. Alternatively, the two automatic uptake dampers 305 are moved to different positions to create a bias. For example, for a bias of 1 inch, if the position instruction for synchronized automatic uptake dampers 305 would be 8 inches open, for biased automatic uptake dampers 305, one of the automatic uptake dampers 305 would be 9 inches open and the other automatic uptake damper 305 would be 7 inches open. The total open area and pressure drop across the biased automatic uptake dampers 305 remains constant when compared to the synchronized automatic uptake dampers 305. The automatic uptake dampers 305 can be operated in synchronized or biased manners as needed. The bias can be used to try to maintain equal temperatures in the push-side and the coke-side of the coke oven 105. For example, the sole flue temperatures measured in each of the sole flue labyrinths 205A and 205B (one on the coke-side and the other on the push-side) can be measured and then corresponding automatic uptake damper 305 can be adjusted to achieve the target oven draft, while simultaneously using the difference in the coke- and push-side sole flue temperatures to introduce a bias proportional to the difference in sole flue temperatures between the coke-side sole flue and push-side sole flue temperatures. In this way, the push- and coke-side sole flue temperatures can be made to be equal within a certain tolerance. The tolerance (difference between coke- and push-side sole flue temperatures) can be 250° Fahrenheit, 100° Fahrenheit, 50° Fahrenheit, or, preferably 25° Fahrenheit or smaller. Using state-of-the-art control methodologies and techniques, the coke-side sole flue and the push-side sole flue temperatures can be brought within the tolerance value of each other over the course of one or more hours (e.g. 1-3 hours), while simultaneously controlling the oven draft to the target oven draft within a specified tolerance (e.g. +/−0.01 inches of water). Biasing the automatic uptake dampers 305 based on the sole flue temperatures measured in each of the sole flue labyrinths 205A and 205B, allows heat to be transferred between the push side and coke side of the coke oven 105. Typically, because the push side and the coke side of the coke bed coke at different rates, there is a need to move heat from the push side to the coke side. Also, biasing the automatic uptake dampers 305 based on the sole flue temperatures measured in each of the sole flue labyrinths 205A and 205B, helps to maintain the oven floor at a relatively even temperature across the entire floor.

The oven temperature sensor 320, the sole flue temperature sensor 325, the uptake duct temperature sensor 330, the common tunnel temperature sensor 335, and the HRSG inlet temperature sensor 340 can be used to detect overheat conditions at each of their respective locations. These detected temperatures can generate position instructions to allow excess air into one or more ovens 105 by opening one or more automatic uptake dampers 305. Excess air (i.e., where the oxygen present is above the stoichiometric ratio for combustion) results in uncombusted oxygen and uncombusted nitrogen in the oven 105 and in the exhaust gases. This excess air has a lower temperature than the other exhaust gases and provides a cooling effect that eliminates overheat conditions elsewhere in the coke plant 100.

As another example, the automatic draft control system 300 can control the automatic uptake damper 305 of an oven 105 in response to uptake duct oxygen concentration detected by the uptake duct oxygen sensor 345. Adjusting the automatic uptake damper 305 in response to the uptake duct oxygen concentration can be done to ensure that the exhaust gases exiting the oven 105 are fully combusted and/or that the exhaust gases exiting the oven 105 do not contain too much excess air or oxygen. Similarly, the automatic uptake damper 305 can be adjusted in response to the HRSG inlet oxygen concentration detected by the HRSG inlet oxygen sensor 350 to keep the HRSG inlet oxygen concentration above a threshold concentration that protects the HRSG 120 from unwanted combustion of the exhaust gases occurring at the HRSG 120. The HRSG inlet oxygen sensor 350 detects a minimum oxygen concentration to ensure that all of the combustibles have combusted before entering the HRSG 120. Also, the automatic uptake damper 305 can be adjusted in response to the main stack oxygen concentration detected by the main stack oxygen sensor 360 to reduce the effect of air leaks into the coke plant 100. Such air leaks can be detected based on the oxygen concentration in the main stack 145.

The automatic draft control system 300 can also control the automatic uptake dampers 305 based on elapsed time within the coking cycle. This allows for automatic control without having to install an oven draft sensor 310 or other sensor in each oven 105. For example, the position instructions for the automatic uptake dampers 305 could be based on historical actuator position data or damper position data from previous coking cycles for one or more coke ovens 105 such that the automatic uptake damper 305 is controlled based on the historical positioning data in relation to the elapsed time in the current coking cycle.

The automatic draft control system 300 can also control the automatic uptake dampers 305 in response to sensor inputs from one or more of the sensors discussed above. Inferential control allows each coke oven 105 to be controlled based on anticipated changes in the oven's or coke plant's operating conditions (e.g., draft/pressure, temperature, oxygen concentration at various locations in the oven 105 or the coke plant 100) rather than reacting to the actual detected operating condition or conditions. For example, using inferential control, a change in the detected oven draft that shows that the oven draft is dropping towards the targeted oven draft (e.g., at least 0.1 inches of water) based on multiple readings from the oven draft sensor 310 over a period of time, can be used to anticipate a predicted oven draft below the targeted oven draft to anticipate the actual oven draft dropping below the targeted oven draft and generate a position instruction based on the predicted oven draft to change the position of the automatic uptake damper 305 in response to the anticipated oven draft, rather than waiting for the actual oven draft to drop below the targeted oven draft before generating the position instruction. Inferential control can be used to take into account the interplay between the various operating conditions at various locations in the coke plant 100. For example, inferential control taking into account a requirement to always keep the oven under negative pressure, controlling to the required optimal oven temperature, sole flue temperature, and maximum common tunnel temperature while minimizing the oven draft is used to position the automatic uptake damper 305. Inferential control allows the controller 370 to make predictions based on known coking cycle characteristics and the operating condition inputs provided by the various sensors described above. Another example of inferential control allows the automatic uptake dampers 305 of each oven 105 to be adjusted to maximize a control algorithm that results in an optimal balance among coke yield, coke quality, and power generation. Alternatively, the uptake dampers 305 could be adjusted to maximize one of coke yield, coke quality, and power generation.

Alternatively, similar automatic draft control systems could be used to automate the primary air dampers 195, the secondary air dampers 220, and/or the tertiary air dampers 229 in order to control the rate and location of combustion at various locations within an oven 105. For example, air could be added via an automatic secondary air damper in response to one or more of draft, temperature, and oxygen concentration detected by an appropriate sensor positioned in the sole flue 205 or appropriate sensors positioned in each of the sole flue labyrinths 205A and 205B.

Figure 5:
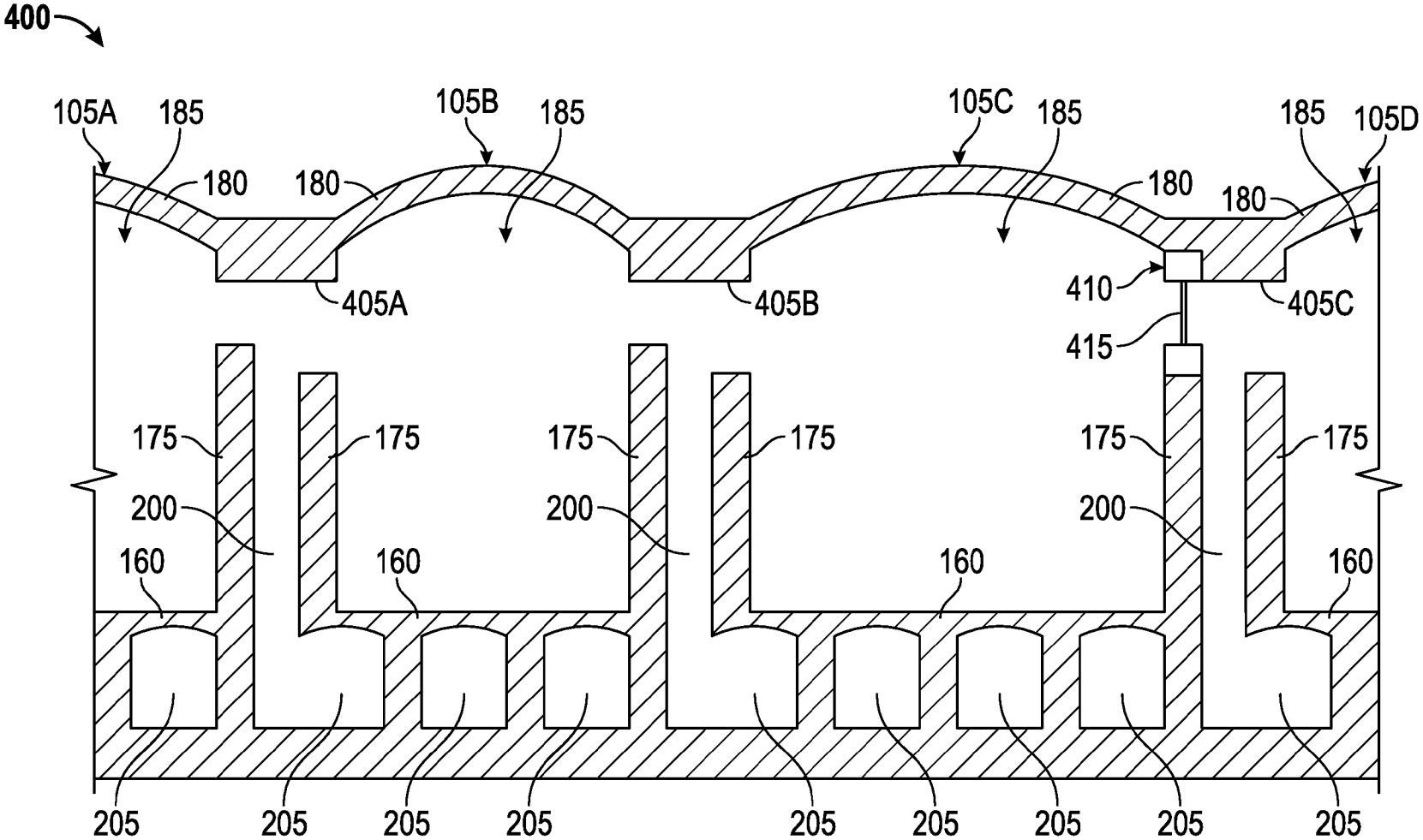
FIG. 5 is a sectional view of multiple HHR coke ovens with a first volatile matter sharing system.

Referring to FIG. 5, in a first volatile matter sharing system 400 coke ovens 105A and 105B are fluidly connected by a first connecting tunnel 405A, coke ovens 105B and 105C are fluidly connected by a second connecting tunnel 405B, and coke ovens 105C and 105D are fluidly connected by a third connecting tunnel 405C. As illustrated, all four coke ovens 105A, B, C, and D are in fluid communication with each other via the connecting tunnels 405, however the connecting tunnels 405 preferably fluidly connect the coke ovens at any point above the top surface of the coke bed during normal operating conditions of the coke oven. Alternatively, more or fewer coke ovens 105 are fluidly connected. For example, the coke ovens 105A, B, C, and D could be connected in pairs so that coke ovens 105A and 105B are fluidly connected by the first connecting tunnel 405A and coke ovens 105C and 105D are fluidly connected by the third connecting tunnel 405C, with the second connecting tunnel 405B omitted. Each connecting tunnel 405 extends through a shared sidewall 175 between two coke ovens 105 (coke ovens 105B and 105C will be referred to for descriptive purposes). Connecting tunnel 405B provides fluid communication between the oven chamber 185 of coke oven 105B and the oven chamber 185 of coke oven 105C and also provides fluid communication between the two oven chambers 185 and a downcomer channel 200 of coke oven 105C.

The flow of volatile matter and hot gases between fluidly connected coke ovens (e.g., coke ovens 105B and 105C) is controlled by biasing the oven pressure or oven draft in the adjacent coke ovens so that the hot gases and volatile matter in the higher pressure (lower draft) coke oven 105B flow through the connecting tunnel 400B to the lower pressure (higher draft) coke oven 105C. Alternatively, coke oven 105C is the higher pressure (lower draft) coke oven and coke oven 105B is the lower pressure (higher draft) coke oven and volatile matter is transferred from coke oven 105C to coke oven 105B. The volatile matter to be transferred from the higher presser (lower draft) coke oven can come from the oven chamber 185, the downcomer channel 200, or both the oven chamber 185 and the downcomer channel 200 of the higher pressure (lower draft) coke oven. Volatile matter primarily flows into the downcomer channel 200, but may intermittently flow in an unpredictable manner into the oven chamber 185 as a "jet" of volatile matter depending on the draft or pressure difference between the oven chamber 185 of the higher pressure (lower draft) coke oven 105B and the oven chamber 185 of the lower pressure (higher draft) coke oven 105C. Delivering volatile matter to the downcomer channel 200 provides volatile matter to the sole flue 205. Draft biasing can be accomplished by adjusting the uptake damper or dampers 230 associated with each coke oven 105B and 105C. In some embodiments, the draft bias between coke ovens 105 and within the coke oven 105 is controlled by the automatic draft control system 300.

Additionally, a connecting tunnel control valve 410 can be positioned in connecting tunnel 405 to further control the fluid flow between two adjacent coke ovens (coke ovens 105C and 105D will be referred to for descriptive purposes). The control valve 410 includes a damper 415 which can be positioned at any of a number of positions between fully open and fully closed to vary the amount of fluid flow through the connecting tunnel 405. The control valve 410 can be manually controlled or can be an automated control valve. An automated control valve 410 receives position instructions to move the damper 415 to a specific position from a controller (e.g., the controller 370 of the automatic draft control system 300).

Figure 6:
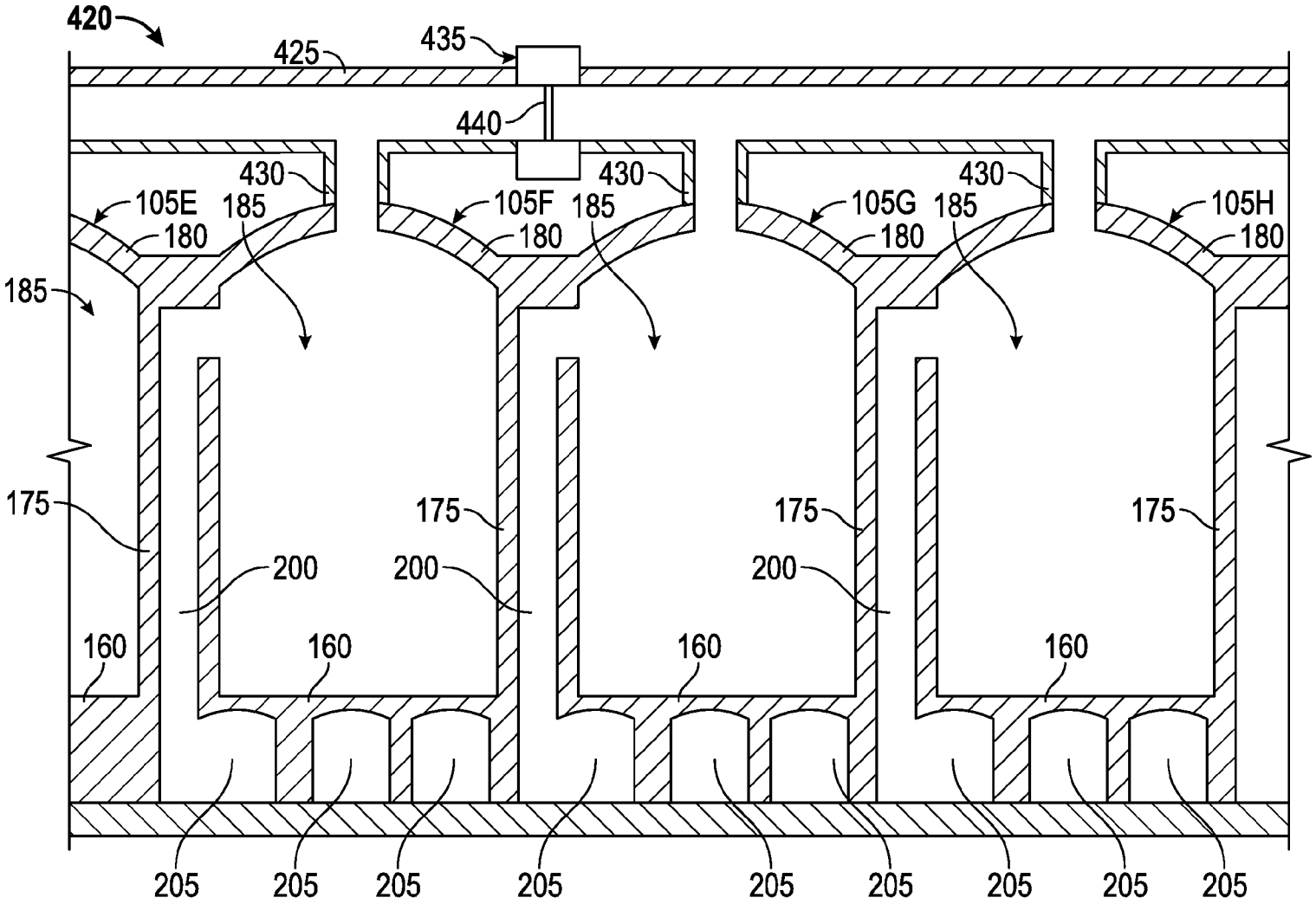
FIG. 6 is a sectional view of multiple HHR coke ovens with a second volatile matter sharing system

Referring to FIG. 6, in a second volatile matter sharing system 420, four coke ovens 105E, F, G, and H are fluidly connected by a shared tunnel 425. Alternatively, more or fewer coke ovens 105 are fluidly connected by one or more shared tunnels 425. For example, the coke ovens 105E, F, G, and H could be connected in pairs so that coke ovens 105E and 105F are fluidly connected by a first shared tunnel and coke ovens 105G and 105H are fluidly connected by a second shared tunnel, with no connection between coke ovens 105F and 105G. An intermediate tunnel 430 extends through the crown 180 of each coke oven 105E, F, G, and H to fluidly connect the oven chamber 185 of that coke oven to the shared tunnel 425.

Similarly to the first volatile matter sharing system 400, the flow of volatile matter and hot gases between fluidly connected coke ovens (e.g., coke ovens 105G and 105H) is controlled by biasing the oven pressure or oven draft in the adjacent coke ovens so that the hot gases and volatile matter in the higher pressure (lower draft) coke oven 105G flow through the shared tunnel 425 to the lower pressure (higher draft) coke oven 105H. The flow of the volatile matter within the lower pressure (higher draft) coke oven 105H can be further controlled to provide volatile matter to the oven chamber 185, to the sole flue 205 via the downcomer channel 200, or to both the oven chamber 185 and the sole flue 205.

Additionally, a shared tunnel control valve 435 can be positioned in the shared tunnel 425 to control the fluid flow along the shared tunnel (e.g., between coke ovens 105F and 105G. The control valve 435 includes a damper 440 which can be positioned at any of a number of positions between fully open and fully closed to vary the amount of fluid flow through the shared tunnel 425. The control valve 435 can be manually controlled or can be an automated control valve. An automated control valve 435 receives position instructions to move the damper 440 to a specific position from a controller (e.g., the controller 370 of the automatic draft control system 300). In some embodiments, multiple control valves 435 are positioned in the shared tunnel 425. For example, a control valve 435 can be positioned between adjacent coke ovens 105 or between groups of two or more coke ovens 105.

Figure 7:
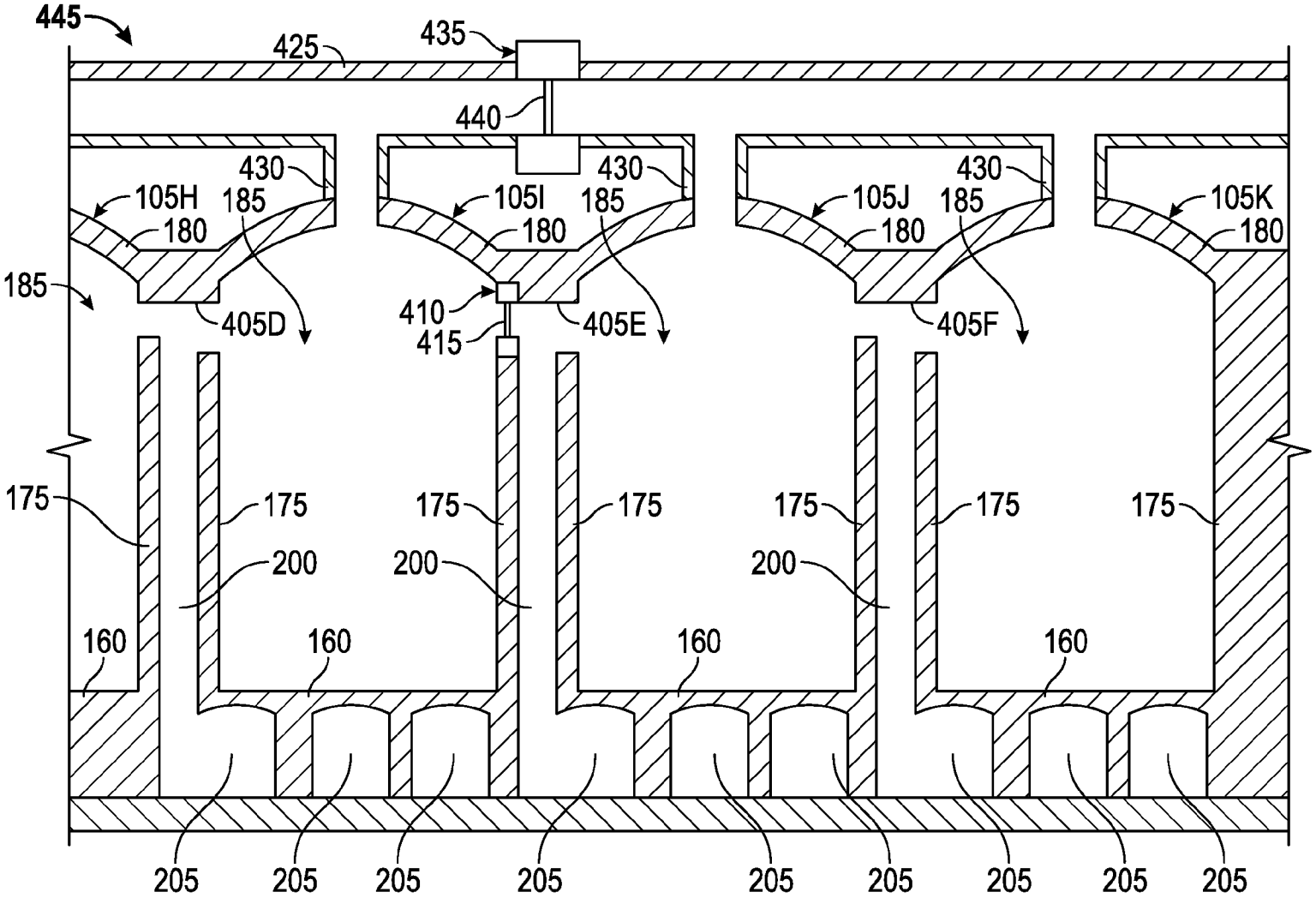
FIG. 7 is a sectional view of multiple HHR coke ovens with a third volatile matter sharing system.

Referring to FIG. 7, a third volatile matter sharing system 445 combines the first volatile matter sharing system 400 and the second volatile matter sharing system 420. As illustrated, four coke ovens 105H, I, J, and K are fluidly connected to each other via connecting tunnels 405D, E, and F and via the shared tunnel 425. In other embodiments, different combinations of two or more coke ovens 105 connected via connecting tunnels 405 and/or the shared tunnel 425 are used. The flow of volatile matter and hot gases between fluidly connected coke ovens 105 is controlled by biasing the oven pressure or oven draft between the fluidly connected coke ovens 105. Additionally, the third volatile matter sharing system 445 can include at least one connecting tunnel control valve 410 and/or at least one shared tunnel control valve 435 to control the fluid flow between the connected coke ovens 105.

Volatile matter sharing system 445 provides two options for volatile matter sharing: crown-to-downcomer channel sharing via a connecting tunnel 405 and crown-to-crown sharing via the shared tunnel 425. This provides greater control over the delivery of volatile matter to the coke oven 105 receiving the volatile matter. For instance, volatile matter may be needed in the sole flue 205, but not in the oven chamber 185, or vice versa. Having separate tunnels 405 and 425 for crown-to-downcomer channel and crown-to-crown sharing, respectively, ensures that the volatile matter can be reliably transferred to correct location (i.e., either the oven chamber 185 or the sole flue 205 via the downcomer channel 200). The draft within each coke oven 105 is biased as necessary for the volatile matter to transfer crown-to-downcomer channel and/or crown-to-crown, as needed.

For all three volatile matter sharing systems 400, 420, and 445, it is important to control oxygen concentration in the coke ovens 105 when transferring volatile matter. When sharing volatile matter, it is important to have the appropriate oxygen concentration in the area receiving the volatile matter (e.g., the oven chamber 185 or the sole flue 205). Too much oxygen will combust more of the volatile matter than needed. For example, if volatile matter is added to the oven chamber 185 and too much oxygen is present, the volatile matter will fully combust in the oven chamber 185, raising the oven chamber temperature above a targeted oven chamber temperature and result in no transferred volatile matter passing from the oven chamber 185 to the sole flue 205, which could result in a sole flue temperature below a targeted sole flue temperature. As another example, when crown-to-downcomer channel sharing, it is important to ensure that there is an appropriate oxygen concentration in the sole flue 205 to combust the transferred volatile matter, or the potential gains in sole flue temperature due to the transferred volatile matter will not be realizes. Control of oxygen concentration within the coke oven 105 can be accomplished by adjusting the primary air damper 195, the secondary air damper 220, and the tertiary air damper 229, each on its own or in various combinations.

Volatile matter sharing systems 400, 420, and 445 can be incorporated into newly constructed coke ovens 105 or can be added to existing coke ovens 105 as a retrofit. Volatile matter sharing systems 420 and 445 appear to be best suited for retrofitting existing coke ovens 105.

Figure 8:
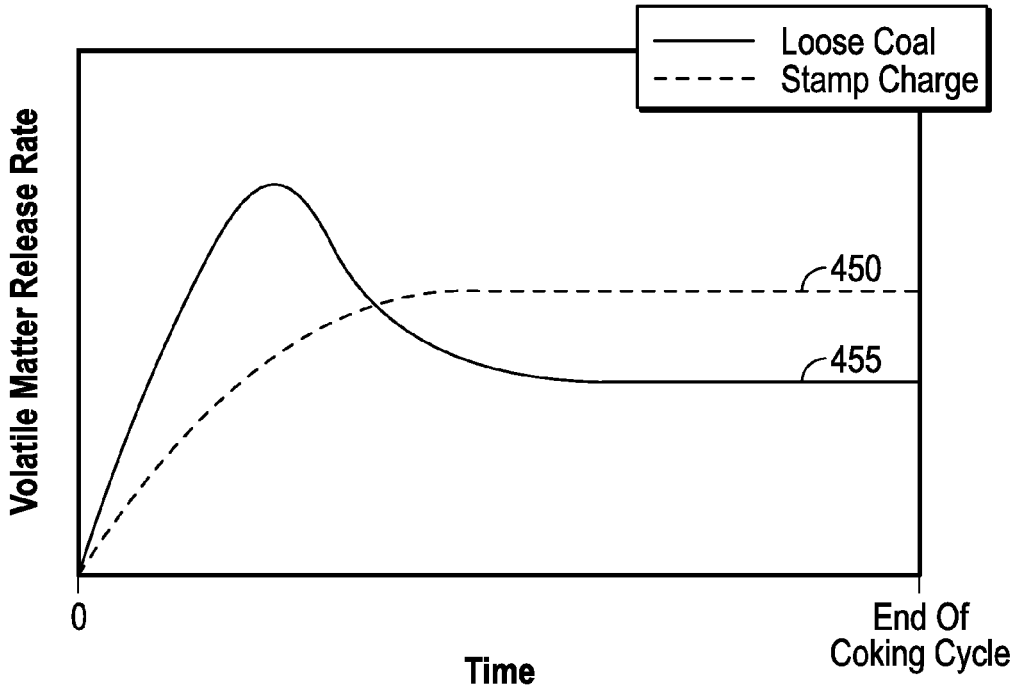
FIG. 8 is a graph comparing volatile matter release rate to time for a coke oven charged with loose coal and a coke oven charged with stamp-charged coal.
Figure 9:
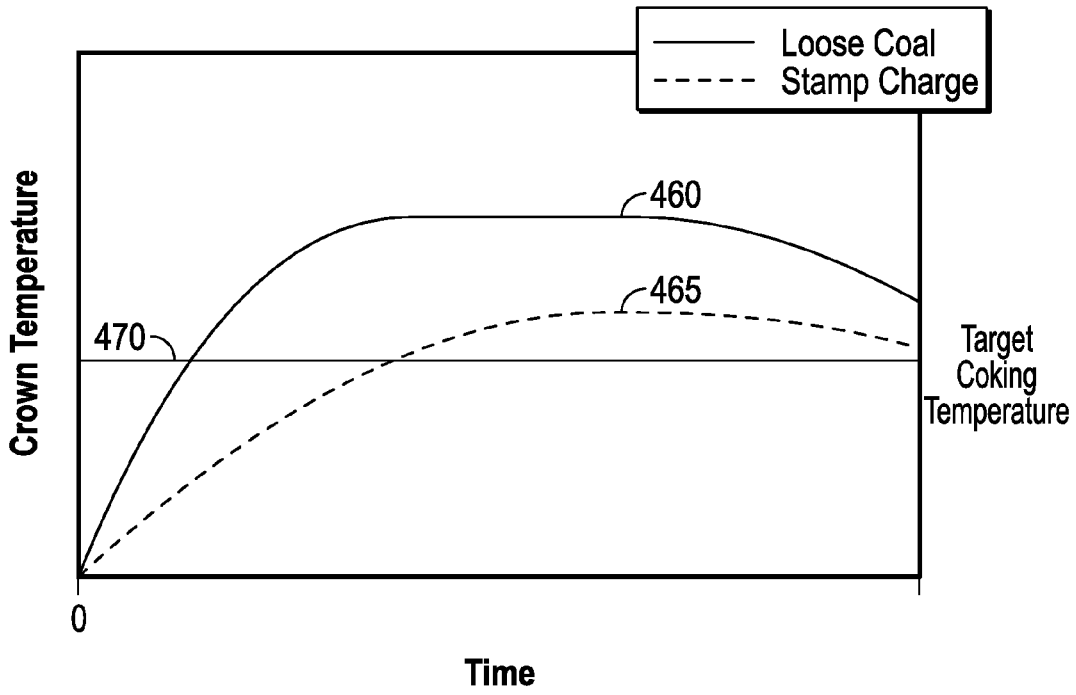
FIG. 9 is a graph comparing crown temperature to time for a coke oven charged with loose coal and a coke oven charged with stamp-charged coal.

A coke plant can be operated using loose coking coal with a relatively low density (e.g., with a specific gravity ("sg") between 0.75 and 0.85) as the coal input or using a compacted, high-density ("stamp-charged") mixture of coking and non-coking coals as the coal input. Stamp-charged coal is formed into a coal cake having a relatively high density (e.g., between 0.9 sg and 1.2 sg or higher). The volatile matter given off by the coal, which is used to fuel the coking process, is given off at different rates by loose coking coal and stamp-charged coal. The loose coking coal gives off volatile matter at a much higher rate than stamp-charged coal. As shown in FIG. 8, the rate at which the coal (loose coking coal shown as dashed line 450 or stamp-charged coal shown as solid line 455) releases volatile matter drops after reaching a peak partway through the coking cycle (e.g., about one to one and a half hours into the coking cycle). As shown in FIG. 9, a coke oven charged with loose coking coal (shown as solid line 460) will heat up at a faster rate (i.e., reach the target coking temperature faster) and reach higher temperatures than a coke oven charged with stamp-charged coal (shown as dashed line 465) due to the higher rate of volatile matter release. The target coking temperature is preferably measured near the oven crown and shown as broken line 470. The lower rate of volatile matter release leads to lower oven temperatures at the crown, a longer time to the target temperature of the coke oven, and a longer coking cycle time than in a loose coking coal charged oven. If the coking cycle time is extended too long, the stamp-charged coal may be unable to fully coke out, resulting in green coke. The lower rate of volatile matter release, longer heat-up time to the target temperature, and lower temperatures at the oven crown for a stamp-charged coke oven compared to a loose coking coal charged coke oven all contribute to a longer coking cycle time for a stamp-charged oven and may result in green coke. These shortcomings of stamp-charged coke ovens can be overcome with volatile matter sharing systems 400, 420, and 445 that allow volatile matter to be shared among fluidly connected coke ovens.

Figure 10:
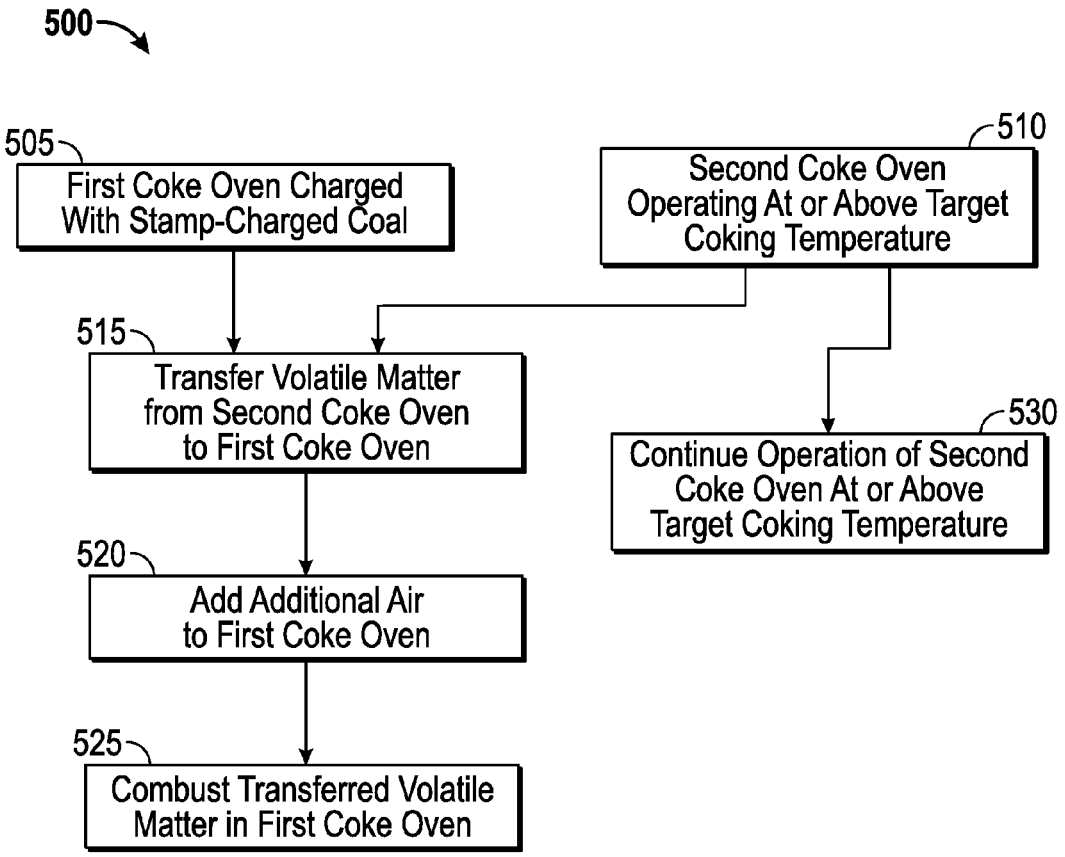
FIG. 10 is a flow chart illustrating a method of sharing volatile matter between coke ovens.
Figure 11:
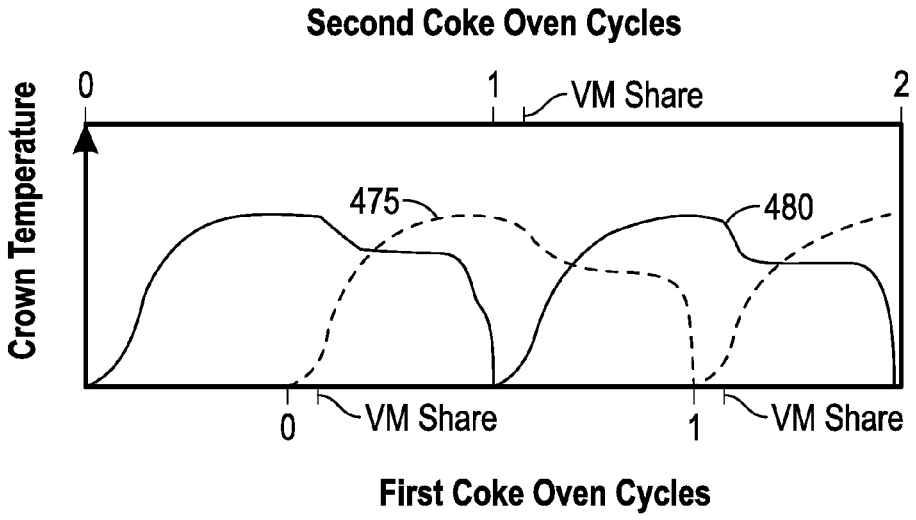
FIG. 11 is a graph comparing crown temperature to coking cycles for a first coke oven and to coking cycles for a second coke oven where the two coke ovens share volatile matter.

In use, the volatile matter sharing systems 400, 420, and 445 allow volatile matter and hot gases from a coke oven 105 that is mid-coking cycle and has reached the target coking temperature to be transferred to a different coke oven 105 that has just been charged with stamp-charged coal. This helps the relatively cold just-charged coke oven 105 to heat up faster while not adversely impacting the coking process in the mid-coking cycle coke oven 105. As shown in FIG. 10, according to an exemplary embodiment of a method 500 of sharing volatile matter between coke ovens, a first coke oven is charged with stamp-charged coal (step 505). A second coke oven is operating at or above the target coking temperature (step 510) and volatile matter from the second coke oven is transferred to the first coke oven (step 515). The volatile matter is transferred between the coke ovens using one of the volatile matter sharing systems 400, 420, and 425. The rate and volume of volatile matter flow is controlled by biasing the oven draft of the two coke ovens, by the position of at least one control valve 410 and/or 435 between the two coke ovens, or by a combination of the two. Optionally, additional air is added to the first coke oven to fully combust the volatile matter transferred from the second oven (step 520). The additional air can be added by the primary air inlet, the secondary air inlet, or the tertiary air inlet as needed. Adding air via the primary air inlet will increase combustion near the oven crown and increase the oven crown temperature. Adding air via the secondary air inlet will increase combustion in the sole flue and increase the sole flue temperature. Combustion of the transferred volatile matter in the first coke oven increases the oven temperature and the rate of oven temperature increase in the first coke oven (step 525), thereby causing the first coke oven to more quickly reach the target coking temperature and decreasing the coking cycle time. The oven temperature in the second coke oven drops, but remains above the target coking temperature (step 530). FIG. 11 illustrates the crown temperature against the elapsed time in each coke oven's coking cycle to show the crown temperature profile of two coke ovens in which volatile matter is shared between the coke ovens according to method 500. The temperature of the first coke oven relative to the elapsed time in the first coke oven's coking cycle is shown as dashed line 475. The temperature of the second coke oven relative to the elapsed time in the second coke oven's coking cycle is shown as solid line 480. The time the transfer of volatile matter to the just-stamp-charged oven begins is noted along the time axes.

Alternatively, volatile matter can be shared between two coke ovens to cool down a coke oven that is running too hot. A temperature sensor (e.g., oven temperature sensor 320, sole flue temperature sensor 325, uptake duct temperature sensor 330) detects an overheat condition (e.g., approaching, at, or above a maximum oven temperature) in a first coke oven and in response volatile matter is transferred from the hot coke oven to a second, cold coke oven. The cold coke oven is identified by a temperature sensed by a temperature sensor (e.g., oven temperature sensor 320, sole flue temperature sensor 325, uptake duct temperature sensor 330). The coke oven should be sufficiently below an overheat condition to accommodate the increased temperature that will result from the volatile matter from the hot coke oven being transferred to the cold coke oven. By removing volatile matter from the hot coke oven, the temperature of the hot coke oven is reduced below the overheat condition.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

It should be noted that the orientation of various elements may differ according to other exemplary embodiments, and that such variations are intended to be encompassed by the present disclosure.

It is also important to note that the constructions and arrangements of the systems as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

What is claimed is:

1. A volatile matter sharing system, comprising:
- a first stamp-charged coke oven;
- a second stamp-charged coke oven;
- a tunnel fluidly connecting the first stamp-charged coke oven to the second stamp-charged coke oven;
- a sensor configured to detect a low temperature condition in the second stamp-charged coke oven; and
- a control valve positioned in the tunnel and adapted to direct heated gas from the first stamp-charged coke oven to the second stamp-charged coke oven in response to a low temperature condition in the second stamp-charged coke oven.

2. The volatile matter sharing system of claim 1, wherein each of the first stamp-charged coke oven and the second stamp-charged coke oven includes an oven chamber; and
- wherein the tunnel extends through a shared sidewall separating an oven chamber of the first stamp-charged coke oven from an oven chamber of the second-stamp charged oven.

3. The volatile matter sharing system of claim 2, further comprising:
- a second tunnel fluidly connecting the first stamp-charged coke oven to the second stamp-charged coke oven;
- wherein each of the first stamp-charged coke oven and the second stamp-charged coke oven includes a crown; and
- wherein at least a portion of the second tunnel is located above at least a portion of the crown of the first stamp-charged coke oven and above at least a portion of the crown of the second stamp-charged coke oven.

4. The volatile matter sharing system of claim 3, further comprising:
- a second control valve positioned in the second tunnel for controlling fluid flow between the first stamp-charged coke oven and the second stamp-charged coke oven.

5. The volatile matter sharing system of claim 3, wherein each of the first stamp-charged coke oven and the second stamp-charged coke oven includes an intermediate tunnel extending through the crown to fluidly connect each oven chamber to the second tunnel.

6. The volatile matter sharing system of claim 3, wherein the first stamp-charged coke oven further includes a sole flue in fluid communication with the oven chamber of the first stamp-charged coke oven and a downcomer channel formed in the shared sidewall, the downcomer channel in fluid communication with the sole flue, the oven chamber of the first stamp-charged coke oven, and the tunnel.

7. The volatile matter sharing system of claim 2, wherein the first stamp-charged coke oven further includes a sole flue in fluid communication with the oven chamber of the first stamp-charged coke oven and a downcomer channel formed in the shared sidewall, the downcomer channel in fluid communication with the sole flue, the oven chamber of the first stamp-charged coke oven, and the tunnel.

8. The volatile matter sharing system of claim 1, wherein each of the first stamp-charged coke oven and the second stamp-charged coke oven includes a crown; and wherein at least a portion of the tunnel is located above at least a portion of the crown of the first stamp-charged coke oven and above at least a portion of the crown of the second stamp-charged coke oven.

9. The volatile matter sharing system of claim 8, wherein each of the first stamp-charged coke oven and the second stamp-charged coke oven includes an intermediate tunnel extending through the crown to fluidly connect each oven chamber to the tunnel.

10. A volatile matter sharing system comprising:

a first stamp-charged coke oven and a second stamp-charged coke oven, each of the stamp-charged coke ovens including, an oven chamber, a sole flue, a downcomer channel fluidly connecting the oven chamber and the sole flue, an uptake duct in fluid communication with the sole flue, the uptake duct configured to receive exhaust gases from the oven chamber, an automatic uptake damper in the uptake duct and configured to be positioned in any one of a plurality of positions including fully open and fully closed according to a position instruction to control an oven draft in the oven chamber, and a sensor configured to detect a low temperature condition of the stamp-charged coke oven;

a tunnel fluidly connecting the first stamp-charged coke oven to the second stamp-charged coke oven;

a control valve positioned in the tunnel and configured to be positioned at any one of a plurality of positions including fully open and fully closed according to a position instruction to direct heated gas between the first stamp-charged coke oven and the second stamp-charged coke oven in response to a low temperature condition in one of the first stamp-charged coke oven and the second stamp-charged coke oven; and a controller in communication with the automatic uptake dampers, the control valve, and the sensors, the controller configured to provide the position instruction to each of the automatic uptake dampers and the control valve in response to the operating conditions detected by the sensors.

11. The volatile matter sharing system of claim 10, wherein each of the sensors are temperature sensors and each operating condition is the oven crown temperature of the respective stamp-charged coke oven.

12. The volatile matter sharing system of claim 10, wherein the tunnel extends through a shared sidewall separating the oven chamber of the first stamp-charged coke oven from the oven chamber of the second-stamp charged oven.

13. The volatile matter sharing system of claim 12, wherein the tunnel is in fluid communication with the downcomer channel of either the first stamp-charged coke oven or the second stamp-charged coke oven.

14. The volatile matter sharing system of claim 10, wherein each of the first stamp-charged coke oven and the second stamp-charged coke oven includes a crown; and wherein at least a portion of the tunnel is located above at least a portion of the crown of the first stamp-charged coke oven and above at least a portion the crown of the second stamp-charged coke oven.

15. The volatile matter sharing system of claim 14, wherein each of the first stamp-charged coke oven and the second stamp-charged coke oven includes an intermediate tunnel extending through the crown to fluidly connect the oven chamber to the tunnel.

16. The volatile matter sharing system of claim 10, further comprising:

a second tunnel fluidly connecting the first stamp-charged coke oven to the second stamp-charged coke oven;

a second control valve positioned in the second tunnel and configured to be positioned at any one of a plurality of positions including fully open and fully closed according to a position instruction to control fluid flow between the first stamp-charged coke oven and the second stamp-charged coke oven; and wherein the controller is in communication with the second control valve and is configured to provide the position instruction to the second control valve in response to the operating conditions detected by the sensors.

17. The volatile matter sharing system of claim 16, wherein each of the first stamp-charged coke oven and the second stamp-charged coke oven includes an intermediate tunnel extending through the crown to fluidly connect the oven chamber to the second tunnel.

18. The volatile matter sharing system of claim 10, wherein each of the sensors are temperature sensors and each operating condition is the sole flue temperature of the respective stamp-charged coke oven.

19. The volatile matter sharing system of claim 10, wherein each of the sensors are temperature sensors and each operating condition is the uptake duct temperature of the respective stamp-charged coke oven.

20. The volatile matter sharing system of claim 10, wherein each of the sensors are pressure sensors and each operating condition is the oven draft of the respective stamp-charged coke oven.

21. The volatile matter sharing system of claim 10, wherein each of the sensors are oxygen sensors and each operating condition is the uptake duct oxygen concentration of the respective stamp-charged coke oven.

22. A method of sharing volatile matter between two stamp-charged coke ovens comprising:

charging a first coke oven with stamp-charged coal;

charging a second coke oven with stamp-charged coal;

operating the second coke oven to produce volatile matter and at a second coke oven temperature at least equal to a target coking temperature;

operating the first coke oven to produce volatile matter and at a first coke oven temperature below the target coking temperature;

transferring volatile matter from the second coke oven to the first coke oven;

combusting the transferred volatile matter in the first coke oven to increase the first coke oven temperature to at least the target coking temperature; and continue operating the second coke oven such that the second coke oven temperature is at least at the target coking temperature.

23. The method of claim 22, further comprising:

providing additional air to the first coke oven to combust the transferred volatile matter.

24. The method of claim 22, further comprising:

biasing an oven draft in the first coke oven and an oven draft in the second coke to transfer the volatile matter from the second coke oven to the first coke oven.

25. The method of claim 24, further comprising:

providing a tunnel between the first coke oven and the second coke oven to establish fluid communication between the two coke ovens.

26. The method of claim 25, further comprising:

controlling the flow of volatile matter through the tunnel with a control valve.

27. The method of claim 22, further comprising:

providing a tunnel between the first coke oven and the second coke oven to establish fluid communication between the two coke ovens for transferring volatile matter; and controlling the flow of volatile matter through the tunnel with a control valve.

28. The method of claim 27, further comprising:

providing a second tunnel between the first coke oven and the second coke oven to establish fluid communication between the two coke ovens for transferring volatile matter; and controlling the flow of volatile matter through the second tunnel with a second control valve.

29. The method of claim 22, wherein transferring volatile matter from the second coke oven to the first coke oven includes transferring volatile matter from an oven chamber of the second coke oven to a downcomer channel of the first coke oven.

30. The method of claim 22, wherein transferring volatile matter from the second coke oven to the first coke oven includes transferring volatile matter from an oven chamber of the second coke oven to an oven chamber of the first coke oven.

31. The method of claim 22, wherein transferring volatile matter from the second coke oven to the first coke oven includes transferring volatile matter from an oven chamber of the second coke oven to a downcomer channel of the first coke oven and transferring volatile matter from an oven chamber of the second coke oven to an oven chamber of the first coke oven.

32. A volatile matter sharing system, comprising:

a first stamp-charged coke oven including a crown;

a second stamp-charged coke oven including a crown;

a sensor configured to detect a low temperature condition in the second stamp-charged coke oven;

a first tunnel fluidly connecting the first coke oven to the second coke oven; and a second tunnel fluidly connecting the first stamp-charged coke oven to the second stamp-charged coke oven, wherein at least a portion of the second tunnel is located above at least a portion of the crown of the first coke oven and above at least a portion of the crown of the second coke oven;

the first tunnel and second tunnel adapted to direct heated gas from the first stamp-charged coke oven to the second stamp-charged coke oven in response to a low temperature condition in the second stamp-charged coke oven.

33. The volatile matter sharing system of claim 32, further comprising: a control valve positioned in the first tunnel for controlling fluid flow between the first coke oven and the second coke oven.

34. The volatile matter sharing system of claim 32, further comprising:

a control valve positioned in the second tunnel for controlling fluid flow between the first coke oven and the second coke oven.

35. The volatile matter sharing system of claim 32, further comprising:

a first control valve positioned in the first tunnel for controlling fluid flow between the first coke oven and the second coke oven; and a second control valve positioned in the second tunnel for controlling fluid flow between the first coke oven and the second coke oven.

* * * * *

UNITED STATES PATENT AND TRADEMARK OFFICE

CERTIFICATE OF CORRECTION

PATENT NO. : 9,249,357 B2
APPLICATION NO. : 13/589004
DATED : February 2, 2016
INVENTOR(S) : John F. Quanci et al.

It is certified that error appears in the above-identified patent and that said Letters Patent is hereby corrected as shown below:

In the Specification

In column 3, line 38, after "system" insert -- . --.

In column 5, line 26, after "245" insert -- . --.

In column 7, line 42, delete "location sin" and insert -- locations in --, therefor.

In column 10, line 39, delete "and or" and insert -- and/or --, therefor.

In the Claims

In column 18, line 32-33, in claim 2, delete "second-stamp charged" and insert -- second stamp-charged --, therefor.

In column 19, line 54, in claim 12, delete "second-stamp charged" and insert -- second stamp-charged --, therefor.

Signed and Sealed this
Fourteenth Day of June, 2016

Michelle K. Lee

Michelle K. Lee
*Director of the United States Patent and Trademark Office*